US010292889B1

(12) United States Patent
McAmis et al.

(10) Patent No.: US 10,292,889 B1
(45) **Date of Patent: *May 21, 2019**

(54) COMPLIANT BIMANUAL REHABILITATION DEVICE AND METHOD OF USE THEREOF

(71) Applicants: Samuel Houston Lawrence McAmis, Tarpon Springs, FL (US); Kyle B. Reed, Tampa, FL (US)

(72) Inventors: Samuel Houston Lawrence McAmis, Tarpon Springs, FL (US); Kyle B. Reed, Tampa, FL (US)

(73) Assignee: University of South Florida, Tampa, FL (US)

( * ) Notice: Subject to any disclaimer, the term of this patent is extended or adjusted under 35 U.S.C. 154(b) by 854 days.

This patent is subject to a terminal disclaimer.

(21) Appl. No.: 14/944,906

(22) Filed: Nov. 18, 2015

Related U.S. Application Data

(63) Continuation of application No. 14/676,452, filed on Apr. 1, 2015, now Pat. No. 9,265,685.
(Continued)

(51) Int. Cl.
*A61H 1/00* (2006.01)

(52) U.S. Cl.
CPC ..... *A61H 1/00* (2013.01)

(58) Field of Classification Search
CPC ..... A61H 1/0274; A61H 1/02; A61H 2001/0203; A61H 2201/12;
(Continued)

(56) References Cited

U.S. PATENT DOCUMENTS 2,928,675 A 3/1960 Nawara
5,234,394 A 8/1993 Wilkinson
(Continued)

FOREIGN PATENT DOCUMENTS

EP 1255591 B1 4/2007
WO WO0156662 A1 8/2001

OTHER PUBLICATIONS

Malabet et al., Symmetric Motions for Bimanual Rehabilitation. 2010 IEEE/RSJ International Conference on Intelligent Robots and Systems. Oct. 18-22, 2010. Taipei, Taiwan: 5133-5138.
(Continued)

*Primary Examiner* — LaToya M Louis
(74) *Attorney, Agent, or Firm* — Javier M. Mixco; Nilay J. Choksi; Smith & Hopen, P.A.

(57) ABSTRACT

A compliant bimanual rehabilitation system. The device allows for the user or operator's hands to be coupled with a variety of coupling stiffnesses and in a variety of symmetry modes, leading to enhanced rehabilitation of the impaired arm. Structurally, the device includes a carrier assembly slidably coupled to a base along a y-axis, an upper assembly rotatably coupled to the carrier assembly along a z-axis, handle slides slidably coupled to the upper assembly along an x-axis, compliant handle assemblies coupled to the handle slides, and handles coupled to the compliant handle assemblies. Encoders and load cells can also be positioned accordingly to monitor the position of the components and force applied to the device. Spring stacks can be coupled to the compliant handle assemblies to adjust coupling stiffnesses. The handles are indirectly linked to each other to facilitate rehabilitation of the paretic arm using the sound arm.

19 Claims, 14 Drawing Sheets

Related U.S. Application Data

(60) Provisional application No. 61/987,186, filed on May 1, 2014.

(58) Field of Classification Search
CPC .... A61H 2201/1253; A61H 2201/1261; A61H 2201/1269; A61H 2201/1276; A61H 2201/1635; A61H 2201/1638; A61H 2201/1664; A61H 2201/1666; A61H 2201/1671; A61H 2201/50; A61H 2201/5064; A61H 2201/5069; A61H 2201/5071; A61B 5/1121; A61B 5/1124; A61B 2505/09; A63B 23/12; A63B 21/154; A63B 21/0428; A63B 22/0015; A63B 22/0017
See application file for complete search history.

(56) References Cited

U.S. PATENT DOCUMENTS

| | | | |
|---|---|---|---|
| 5,267,926 | A | 12/1993 | Schaefer |
| 5,484,368 | A | 1/1996 | Chang |
| 7,850,579 | B2 | 12/2010 | Whitall et al. |
| 7,951,050 | B2 | 5/2011 | Raumann et al. |
| 8,021,286 | B2 | 9/2011 | Suiter |
| 8,038,579 | B2 | 10/2011 | Wei et al. |
| 8,317,730 | B2 | 11/2012 | Zhang et al. |
| 8,485,996 | B2 | 7/2013 | Bluman |
| 8,523,792 | B2 | 9/2013 | Weisz et al. |
| 8,613,715 | B2 | 12/2013 | Wright et al. |
| 2003/0028130 | A1 | 2/2003 | Wunderly et al. |
| 2004/0029689 | A1 | 2/2004 | Contreras |
| 2004/0053756 | A1 | 3/2004 | Tremayne |
| 2005/0032613 | A1 | 2/2005 | Wehrell |
| 2008/0000317 | A1 | 1/2008 | Patton et al. |
| 2009/0062698 | A1 | 3/2009 | Elinav et al. |
| 2009/0181834 | A1 | 7/2009 | Campanaro et al. |
| 2011/0166003 | A1 | 7/2011 | Brice et al. |
| 2011/0213267 | A1 | 9/2011 | Kakei et al. |
| 2011/0264018 | A1 | 10/2011 | Matjacic et al. |
| 2011/0300994 | A1 | 12/2011 | Verkaaik et al. |
| 2012/0029391 | A1 | 2/2012 | Sung et al. |
| 2012/0053498 | A1 | 3/2012 | Horst |
| 2012/0083395 | A1 | 4/2012 | Carson |
| 2012/0179075 | A1 | 7/2012 | Perry et al. |
| 2013/0059696 | A1 | 3/2013 | Hijmans et al. |
| 2013/0060171 | A1 | 3/2013 | Fu et al. |
| 2013/0210593 | A1 | 8/2013 | McBride et al. |
| 2013/0237883 | A1 | 9/2013 | Malosio et al. |
| 2013/0345604 | A1 | 12/2013 | Nakamura |
| 2014/0046226 | A1 | 2/2014 | Weisz et al. |
| 2014/0287390 | A1 | 9/2014 | Byblow et al. |

OTHER PUBLICATIONS

Lum et al., Robotic assist devices for bimanual physical therapy: preliminary experiments. IEEE transactions on rehabilitation engineering. 1993. vol. 1 (No. 3): 185-191.

Lum et al., The bimanual lifting rehabilitator: an adaptive machine for therapy of stroke patients. IEEE transactions on rehabilitation engineering. 1995. vol. 3 (No. 2): 166-174.

Trlep et al., Rehabilitation Robot with Patient-Cooperative Control for Bimanual Training of Hemiparetic Subjects. Advanced Robotics. 2011. vol. 25: 1949-1968.

Marchal-Crespo et al., Review of control strategies for robotic movement training after neurologic injury. Journal of NeuroEngineering and Rehabilitation. 2009. vol. 60: 1-15.

Kwakkel et al., Effects of Robot-Assisted Therapy on Upper Limb Recovery After Stroke: A Systematic Review. Neurorehabil Neural Repair. 2007. vol. 22: 111-121.

Schmidt, R.A. et al. R. A. "New conceptualizations of practice: Common principles in three paradigms suggest new concepts for training," Psychological Science, vol. 3, No. 4, pp. 207-217, 1992.

McAmis and Reed. Symmetry modes and stiffnesses for bimanual rehabilitation. IEEE Int. Conf. Rehabilitation Robotics. 2011. Zurich Science City, Switzerland: 1106-1111.

Oden., Robert. Systematic therapeutic exercises in the management of the paralyses in hemiplegia. JAMA. 1918. vol. 70 (No. 12): 828-833.

Taub et al., Constraint-induced movement therapy: A new family of techniques with broad application to physical rehabilitation—a clinical review. Journal of Rehabilitation Res. 1999. vol. 36 (No. 3): 237-251.

Johnson et al., Potential of a suite of robot/computer-assisted motivating systems for personalized, home-based, stroke rehabilitation. Journal of NeuroEngineering and Rehabilitation. 2007. vol. 4: 1-17.

Reinkensmeyer et al., Java therapy: Web-based robotic rehabilitation. Integration of Assistive Technology in the Information Age. 2001. vol. 9: 66-71.

Burgar et al., Development of robots for rehabilitation therapy: The Palo Alto VA/Stanford experience. J. of Rehab Research and Development. 2000. vol. 37 (No. 6): 663-674.

Wolf et al., Comparison of Motor Copy and Targeted Biofeedback Training Techniques for Restitution of Upper Extremity Function Among Patients with Neurologic Disorders. Physical Therapy. 1989. vol. 69. (No. 9): 719-735.

Hesse et al., Robot-assisted arm trainer for the passive and active practice of bilateral forearm and wrist movements in hemiparetic subjects. Archives of Physical Medicine and Rehab. 2003. vol. 84: 915-920.

Whitall et al., Repetitive Bilateral Arm Training With Rhythmic Auditory Cueing Improves Motor Function in Chronic Hemiparetic Stroke. Stroke. 2000. vol. 31: 2390-2395.

Jordan et al., Imable system for upper limb stroke rehabilitation. International Conference on Virtual Rehabilitation (ICVR). Jun. 2011: 1-2.

Hesse et al., Mechanical arm trainer for the treatment of the severely affected arm after a stroke. Am J Phys Med Rehabil. 2008. vol. 87 (No. 10): 779-788.

McAmis and Reed. Simultaneous perception of forces and motions using bimanual interactions. IEEE Transaction on Haptics. 2012. vol. 5 (No. 3): 220-230.

Lum et al. "Robotic devices for movement therapy after stroke: Current status and challenges to clinical acceptance," Topics in Stroke Rehab, vol. 8, pp. 40-53, 2002.

McAmis and Reed. Design and Analysis of a Compliant Bimanual Rehabilitation Device. . IEEE International Conference on Rehabilitation Robotics. Jun. 24-26, 2013. Seattle, Washington. 2013.

COMPLIANT BIMANUAL REHABILITATION DEVICE AND METHOD OF USE THEREOF

CROSS-REFERENCE TO RELATED APPLICATIONS

This nonprovisional application is a continuation of and claims priority to U.S. Nonprovisional patent application Ser. No. 14/676,452, entitled "Compliant Bimanual Rehabilitation Device and Method Of Use Thereof", filed Apr. 1, 2015 by the same inventors, which claims priority to U.S. Provisional Patent Application No. 61/987,186, entitled "Compliant Bimanual Rehabilitation Device and Method of Use Thereof", filed May 1, 2014 by the same inventors, both of which are incorporated herein by reference in their entireties.

BACKGROUND OF THE INVENTION

1. Field of the Invention

This invention relates, generally, to bimanual rehabilitation. More specifically, it relates to a device and method for bimanual rehabilitation for persons with hemiparesis.

2. Brief Description of the Prior Art

The goal of upper-limb rehabilitation following a stroke is to enable a person to use both hands in activities of daily living. Of the new rehabilitation methods proposed and tested in recent years, many show positive results [1][2], but there is a need for a more effective method that clearly shows better results than traditional methods. A common thread among the successful studies is that the amount of time spent training the affected arm plays an important role in improving the functional ability of the affected arm. As it is difficult for therapists to devote as much time as is needed, researchers have looked to robotic techniques, bimanual techniques, and other techniques to supplement the rehabilitation.

Traditional and Robotic Rehabilitation Techniques

Conventional stroke rehabilitation therapies, such as the Bobath method [3] and proprioceptive neuromuscular facilitation [4] have been used for decades. However, these methods are time-consuming and require significant effort from physical therapists. Forced use [5] and the more recently developed Constraint-Induced Movement Therapy [6] bind the sound arm and force the individual to use only the paretic limb; however, this therapy is only viable for small to moderate impairment.

In recent years, robotic technologies have been used to provide rehabilitation to individuals, allowing access to rehabilitation for longer and more frequent periods of time. However, recent publications have noted that it is unclear whether robotic methods have the potential to produce greater benefits than conventional techniques when practiced for the same amount of time [1][2].

To allow patients greater access to rehabilitative training, several methods have been developed to allow patients to rehabilitate at home [7][8]. However, many of these home-based methods use a home computer with limited accessories that cannot provide assistance forces and can only operate over a small workspace. These methods are able to provide some benefit, but the rehabilitation effect is limited to individuals already having relatively high motor function.

Bimanual Rehabilitation

Bimanual rehabilitation allows individuals with hemiparesis to use their sound arm to help rehabilitate their impaired arm through simultaneous bimanual motions. Bimanual rehabilitation shows promise as a means of low cost home use rehabilitation. The key mechanism of rehabilitation is that the same neural signal is sent to both arms, which results in the same proprioceptive feedback from each limb since the arms are constrained to move together. Sending the same efferent signals to each limb results in similar afferent signals from the limbs, which helps re-train the motor pathways to the impaired side/limb [9][10]. Several research groups have studied certain aspects of coupled and uncoupled bimanual rehabilitation [11][12][13][14][15], but few studies have examined what the ideal physical parameters for bimanual interaction should be.

The foregoing studies [11][12][13][14][15] either did not physically connect the hands or coupled the hands rigidly, and few studies have analyzed the effect of the coupling stiffness. An effective coupling stiffness is likely an intermediate stiffness, since a soft coupling would prevent severely impaired individuals from using this training method. With a completely rigid connection, the individual is likely to apply minimal force in their impaired hand since the healthy side would dictate all the motions [1][16].

Further, it is not currently known which types of symmetry modes are most effective for bimanual rehabilitation. Mirror motions have been the most commonly used in bimanual rehabilitation studies to date. However, most daily tasks occur in a visual reference frame where the hands move in the same direction. Three common reference frames used in bimanual rehabilitation are Mirror or Joint Space Symmetry (JSS), Visual Symmetry (VS), and Point Mirror Symmetry (PMS) [17][18] (see FIG. 1).

Preliminary studies of bimanual symmetric motions on healthy participants have shown that it is easier to follow and recreate motions in VS and JSS than in PMS [19] and that a coupling stiffness of 200 N/m or greater resulted in better path following and motion coupling. These studies were performed on a pair of PHANTOM OMNI force feedback devices.

Certain devices and methodologies for bimanual rehabilitation do exist in the art, though most use either a rigid physical coupling or a large robotic device to effect the coupling, since the best combination of bimanual symmetry modes and coupling stiffnesses is unknown. For example, U.S. Pat. No. 7,850,579 to Whitall et al. (also published as EP 1255591 B1 and WO2001056662 A1) relates to a device for bilateral upper extremity training for patients with a paretic upper extremity, and more specifically, to a device providing bilateral upper extremity training that facilitates cortical remodeling. However, the bilateral arm trainer of Whitall et al. includes two separate handles on slides for each hand and the two motions are uncoupled except via the person's control, thus failing to provide physical coupling of the motions together in multiple symmetry modes.

U.S. Patent App. Pub. No. 2012/0029391 A1 to Sung et al. relates to a bilateral upper limbs motor recovery rehabilitation and evaluation system for patients with stroke. However, Sung et al. focuses on evaluating the amount of asymmetry an individual with stroke has. The system is designed to allow an individual to move bilaterally with both arms and measures the difference between the two arms and defines metrics to aid in evaluation. It does not include a semi-compliant physical connection or a method to switch between different symmetry modes.

U.S. Pat. No. 8,038,579 to Wei et al. relates to a system adapted to stroke patients for training and evaluating bilateral symmetric force output. However, the focus of Wei et al. is the force being mediated by a motor, which becomes costly and less user-intuitive for a home-user thereof.

Symmetric Motions for Bimanual Rehabilitation. Hernando Gonzalez Malabet, Rafael Alvarez Robles, and Kyle B. Reed. Oct. 18-22, 2010, Taipei, Taiwan relates to the development of bimanual rehabilitation for home-use. Although this publication is relevant to bimanual rehabilitation, it is more theoretical in nature and furthers an understanding of how people couple motions, but does not discuss a device or method for coupling the hands.

Peter S. Lum, David J. Reinkensmeyer, Member, IEEE, and Steven L. Lehman, Associate Member, IEEE. Robotic assist devices for bimanual physical therapy: preliminary experiments. IEEE transactions on rehabilitation engineering, vol. 1, no. 3 sefizmber 1993 relates to the development of a device, operating under simple control laws, to assist a disabled hand, allowing performance of coordinated bimanual tasks. However, this publication is focused on bimanual wrist actuation and would not be conducive for whole arm movements.

Peter S. Lum, Steven L. Lehman, Associate Member, IEEE, and David J. Reinkensmeyer, Member, IEEE. The bimanual lifting rehabilitator: an adaptive machine for therapy of stroke patients. IEEE transactions on rehabilitation engineering, vol. 3. no. 2, June 1995 relates to the development of inexpensive bimanual lifting rehabilitators, each designed to retrain coordination in a specific activity of daily living, which could be used by physical and occupational therapists. This paper is focused on performing motions bimanually, but not on using one hand to assist the other during a reaching task. The "rehabilitator", rather than the person's healthy hand, assists the impaired hand, and the device enables only a limited type of rehabilitation.

Matic Trlepa, Matjaž Mihelj a Urška Puhb and Marko Muni. Rehabilitation Robot with Patient-Cooperative Control for Bimanual Training of Hemiparetic Subjects. Advanced Robotics: Volume 25, Issue 15, 2011 relates to the development and validation of a bimanual training system that stimulates the use of both arms of hemiparetic subjects. The adaptive assistance control adjusts the contribution of the unaffected arm, thus reducing the load on the paretic arm. This paper presents a bimanual rehabilitation method that couples the motions of both hands through an "adaptive assistance" paradigm that works by controlling how much force the sound arm can contribute to the overall motion using admittance control. The coupling in this system is effected by a rigid coupling to a robotic device, rather than a passive compliant coupling, and enables limited symmetry types.

Accordingly, what is needed is a more effective device and methodology for bimanual rehabilitation. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an upper limb rehabilitation system is now met by a new, useful, and nonobvious invention.

In an embodiment, the current invention is a rehabilitation system including a compliant bimanual rehabilitation device. The device comprises a base that defines the x-, y-, and z-axes of the device as a whole. A carrier assembly is slidably coupled to the base (e.g., via slide rails mounted on the top of the base) along the y-axis of the device. An upper assembly is rotationally coupled to the carrier assembly about the z-axis of the device. A handle slide is slidably coupled each end of the upper assembly along the x-axis of the device. A compliant handle assembly is coupled to each handle slide. A handle is fixedly coupled to each compliant handle assembly. Each handle permits a large range of arm movement. One of the handles is a guiding handle used by the user's sound arm, and the other handle is the following handle used by the user's paretic arm. The handles are indirectly linked to each other at an adjustable, predetermined coupling stiffness, such that when the device is in use, the user's paretic arm is linked to the user's sound arm. Thus, a movement of the guiding handle dictates a corresponding movement of the following handle according to a predetermined symmetry mode (e.g., JSS, VS, PMS).

The device may further include encoders in communication with one or more of the following: handle slides to determine a position of each handle slide along the x-axis, carrier assembly to determine a position of the carrier assembly along the y-axis, and upper assembly to determine a position of the upper assembly along the z-axis. In any case, each encoder would be in further communication with an electronic or computing device to transmit the position of the communicating structure to the electronic or computing device.

The device may further include load cells in communication with the compliant handle assemblies to determine an amount of force put on each compliant handle assembly by the user. The load cells would be in further communication with an electronic or computing device to transmit the amounts of force on the compliant handle assemblies to the electronic or computing device.

Each compliant handle assembly may be formed of a first component coupled to the handle slide and extending along the y-axis of the device and a second component coupled to the first component and extending inwardly from the first component. In this case, a load cell, as described, can be positioned along each component, resulting in at least four (4) load cells being disposed in the device.

The handles may be indirectly linked to each other via the handle slides being coupled to each other, which, in turn, couples the compliant handle assemblies together as well. In a further embodiment, the handle slides may be coupled to each other via a cable and pulley system. In this cable and pulley system, when the cable is looped around the pulleys an even number of times, the handles move in the same absolute direction; on the other hand, when the cable is loops around the pulleys an odd number of times, the handles mirror each other in movement.

The compliant bimanual rehabilitation device may further include a first locking mechanism for restricting movement of the upper assembly in the z-axis and a second locking mechanism for restricting movement of the carrier assembly in the y-axis.

The rehabilitation system may further include a visual display communicatively coupled to the compliant bimanual rehabilitation device for indicating a current position of each handle, where the indicated positions move as the handles respectively move. Further, the visual display may also indicate a target position of each handle, whereby a goal of the user is to align the current positions with the target positions.

The compliant bimanual rehabilitation device may further include a spring system coupled to each compliant handle assembly to provide a bias against movement of the handles. The spring system can include one or more springs positioned at the joint between the handle slide and the compliant handle assembly and also positioned along each compliant handle assembly, resulting in at least four (4) sets of springs. If the compliant handle assemblies are formed of the components, as described above, then the springs disposed along each compliant handle assembly can be positioned between the components of each compliant handle assembly. The spring systems may be formed of spring stacks formed of a plurality of torsion springs stacked or abutting one another. Based on the needs of the user, the coupling stiffness can be adjusted by adding or removing torsion springs from the spring stacks. These torsion springs may each include a central portion that is coupled at the joints, along with two (2) forks having longitudinal extents that are angled (e.g., substantially perpendicular) relative to each other.

In a separate embodiment, the current invention is a rehabilitation device including a compliant bimanual rehabilitation device, comprising any one or more, or even all, of the foregoing characteristics or limitations.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 11A corresponds to JSS and PMS. FIG. 11B corresponds to VS. The right end of FIG. 11B would be fully extended (not shown).

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Bimanual rehabilitation allows an individual to self-rehabilitate by guiding his paretic arm with his sound arm using an external physical coupling. This coupling allows the individual to move his impaired hand through motions he would not otherwise be able to make while still giving him complete control over the motion generated, something that a physical therapist or robot would not be able do. This method also allows for upper-limb rehabilitation devices that are significantly lower in cost than robotic systems since much of the required force could be provided by the patient's healthy limb instead of the larger motors included on many current upper-limb rehabilitation robots. This would result in a lower cost and safer rehabilitation method that could be used at home, increasing access to rehabilitation. In an embodiment, the current invention is a device that allows the hands to be coupled in several common symmetry modes and with a selectable coupling stiffnesses. The device was tested with healthy subjects in tasks that mimic aspects of hemiparesis as well as standard bimanual tasks.

Figure 1:
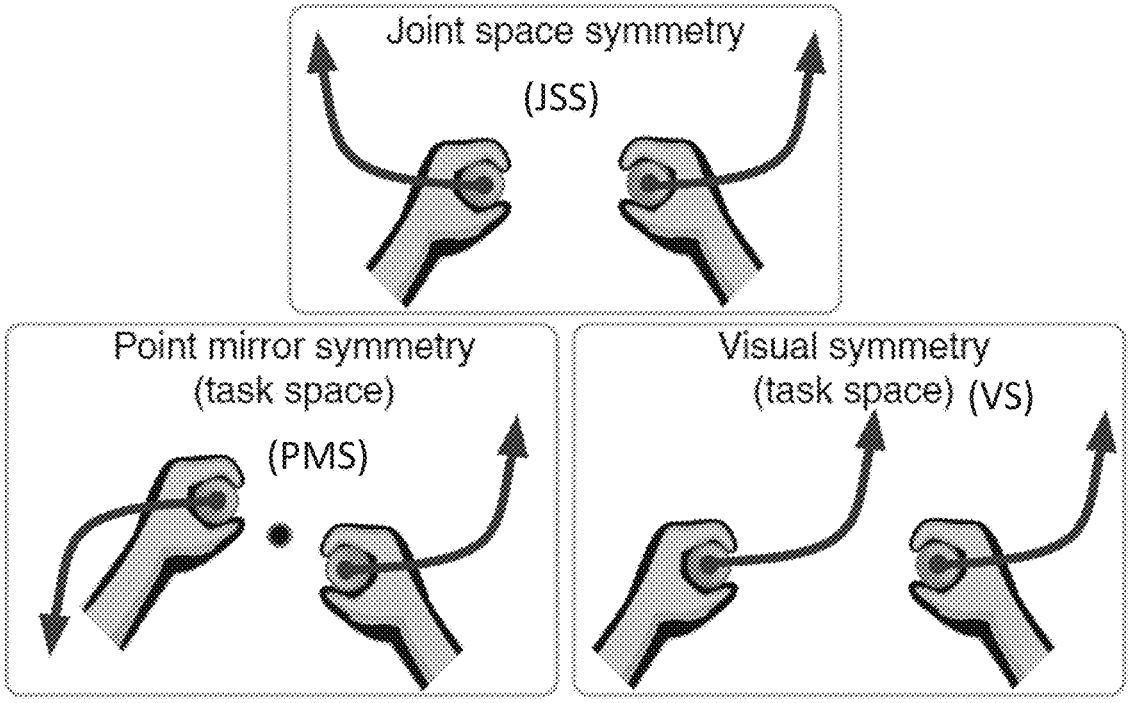
FIG. 1 (prior art)
FIG. 1 depicts common bimanual symmetry modes including Joint Space Symmetry (JSS) where the joint angles are mirrored, Visual Symmetry (VS) where the hands move through the same visual path, and Point Mirror Symmetry (PMS) where the hand motions are mirrored about a point in space.

In an embodiment, the current invention is a compliant bimanual rehabilitation device ("CBRD") that physically couples two handles in any configuration, for example one or more of the symmetries shown in FIG. 1, with an adjustable/selectable coupling stiffness.

Figure 2:
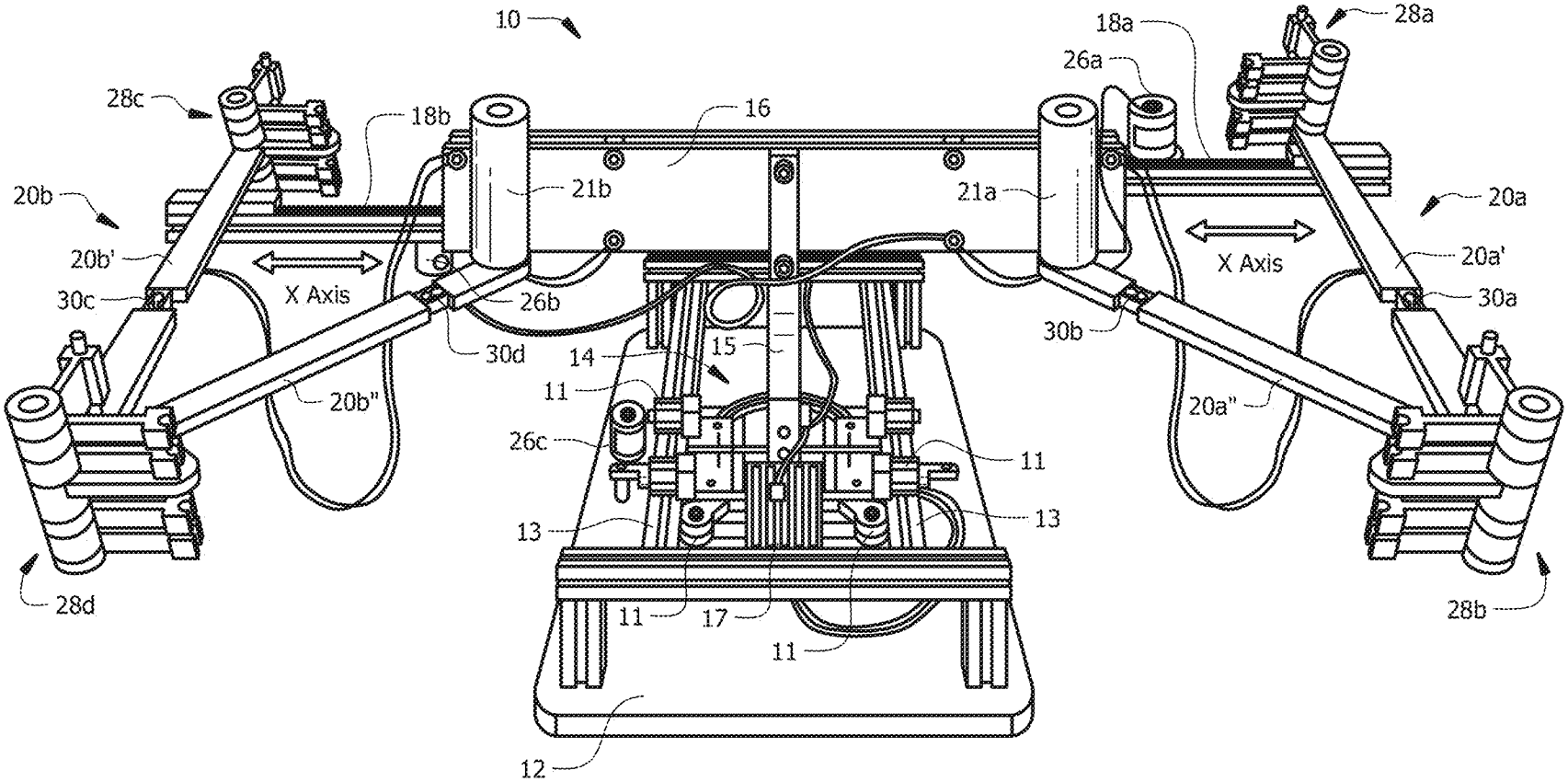
FIG. 2 is a front perspective view of a compliant bimanual rehabilitation device according to an embodiment of the current invention.
Figure 9A:
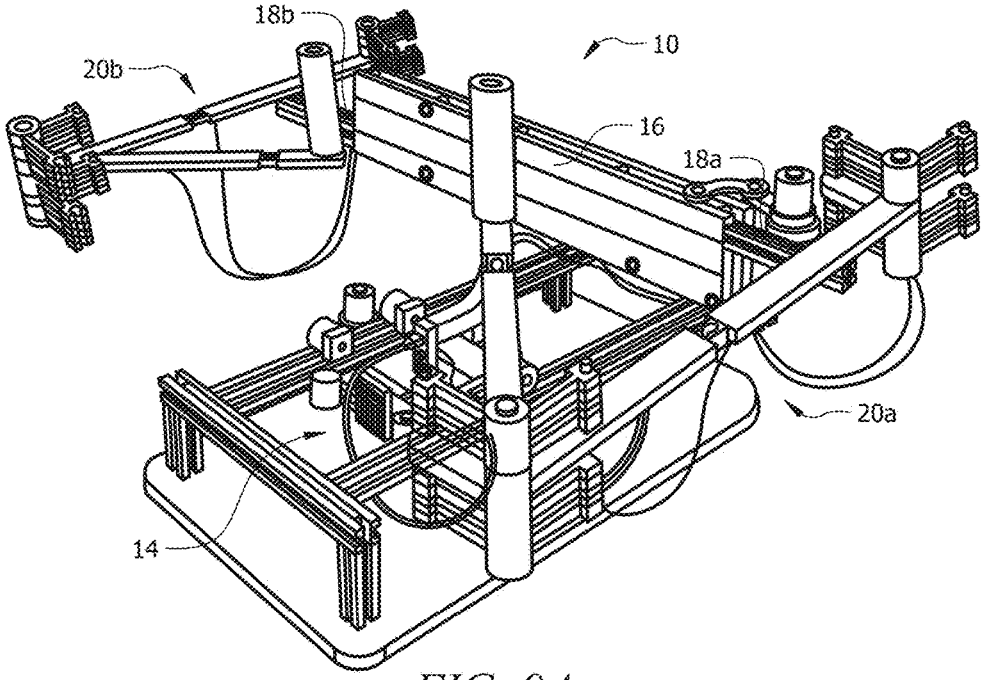
FIG. 9A shows the compliant handle slide in a contracted position along the x-axis.
Figure 9B:
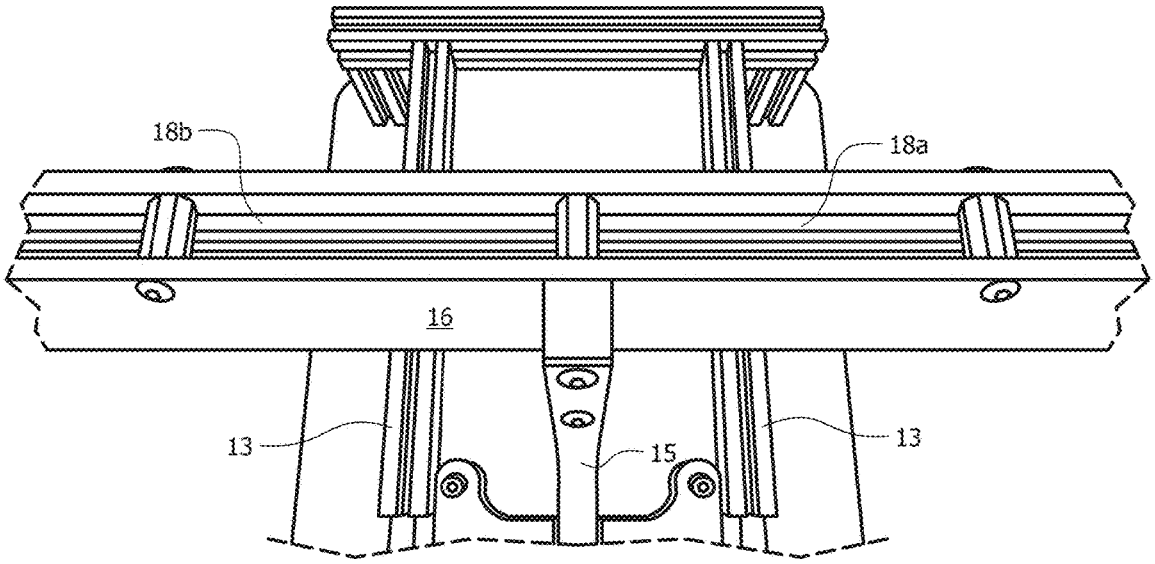
FIG. 9B shows disposition of the compliant handle slides within the upper assembly when in the contracted position of FIG. 11A.
Figure 10:
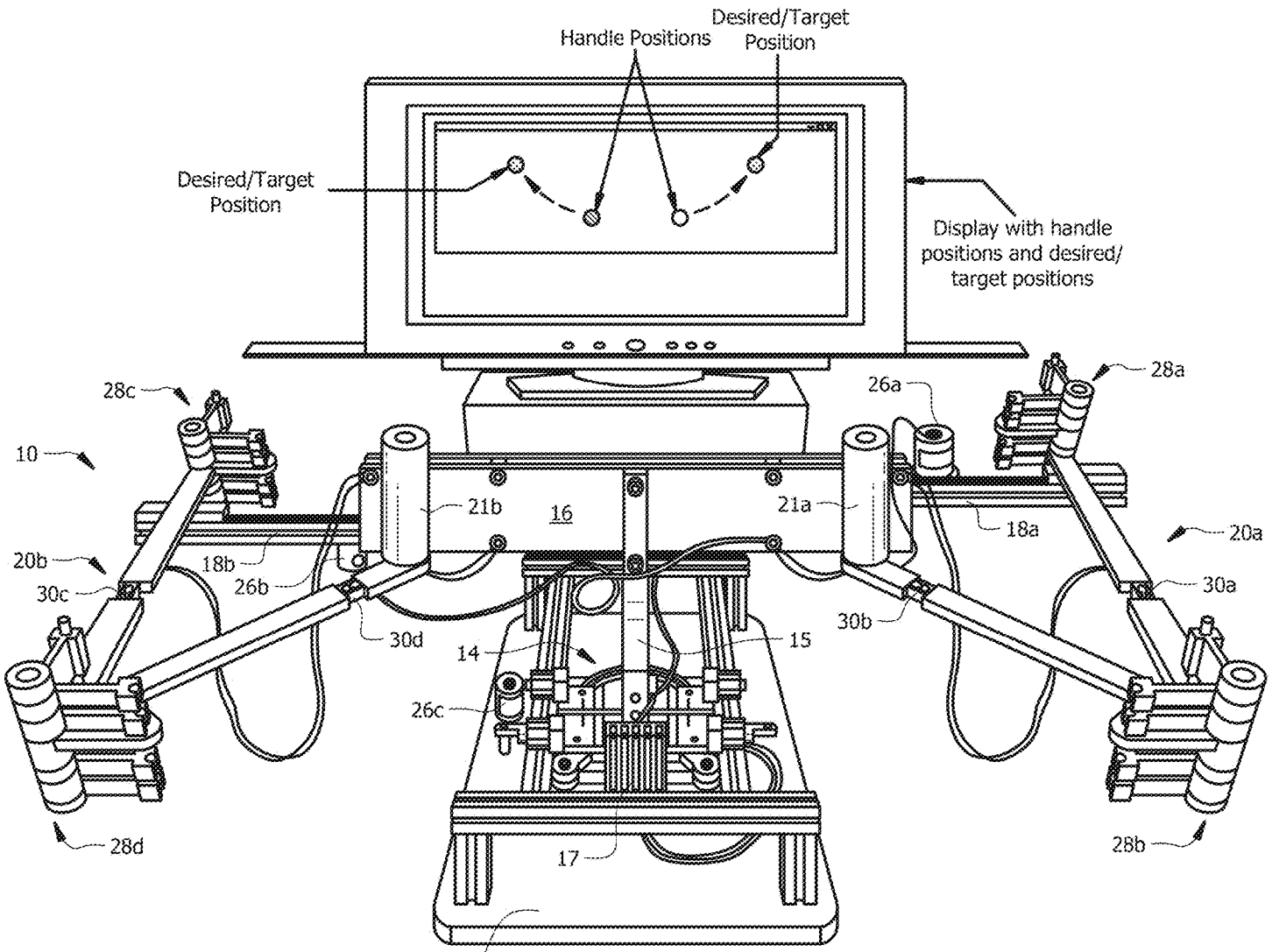
FIG. 10 depicts an embodiment of the compliant bimanual rehabilitation device (CBRD) implemented with an interaction game on a visual display. Handle positions are displayed as the middle/interior dots/circles on the visual display. Desired/target positions are displayed as the outer dots/circles on the visual display.

The device can be seen in FIGS. 2-10 and is generally denoted as reference numeral 10. Referring to FIG. 2, the CBRD includes a guiding handle physically coupled to a following handle, wherein the guiding handle controls direction of movement of the following handle in a predetermined symmetry mode (e.g., joint space symmetry, point mirror symmetry, visual symmetry), and wherein the physical coupling of the guiding handle and the following handle has an adjustable, predetermined coupling stiffness. As can be seen in FIG. 10, the CBRD can be communicatively coupled to a visual display for indicating a current left position of the left handle, a target left position of the left handle, a current right position of the right handle, and a target right position of the right handle.

Device 10 is divided into several sub-assemblies: the coupling system that connects the handle in a desired symmetry mode, formed of carrier assembly 14 and upper assembly 16, and compliant handle assemblies 20*a*, 20*b* that allow the handles to be moved away from the correct symmetric positions but provide a spring force back towards the symmetric positions.

More specifically, CBRD device 10 includes base 12 that defines a top, a bottom, a left side, a right side, an x-axis, and a y-axis of CBRD device 10. Carrier assembly 14 is mounted on top of base 12 and is slidably coupled to base 12 along slide rails 13, where carrier assembly 14 is slidable along the y-axis of device 10, for example via wheels or spools 11 (e.g., eight (8) wheels 11 can be seen, four (4) sliding along the top of slide rails 13 and four (4) sliding along the side (inside) of slide rails 13) slidable along the inside of slide rails 13. Upper assembly 16 is rotationally coupled to carrier assembly 14 via connector 15, where the upper assembly 16 is rotational along the z-axis of device 10.

Right handle slide 18*a* is slidably coupled to the right end of upper assembly 16, where right handle slide 18*a* is slidably received within and along upper assembly 16, such that right handle slide 18*a* is slidable along the x-axis of device 10. This will become clearer as this specification continues. Right compliant handle assembly 20*a* is coupled to right handle slide 18*a* and extends proximally from right handle slide 18*a* substantially along the y-axis of device 10, substantially perpendicular to the longitudinal axis of slide rails 13 (see right compliant handle assembly component 20*a*') and then inwardly toward base 12 (see right compliant handle assembly component 20*a*"). Right handle 21*a* is rigidly coupled to the free end of right compliant handle assembly 20*a* to permit a large range of right arm movement.

Spring stack 28*a* can be positioned at the connection point between right handle slide 18*a* and right compliant handle assembly 20*a*. Spring stack 28*b* can be positioned at the joint or connection point between right compliant handle assembly component 20*a*' and right compliant handle assembly component 20*a*". Spring stacks 28*a*, 28*b* will become clearer as this specification continues.

Left handle slide 18*b* is slidably coupled to the left end of upper assembly 16, where left handle slide 18*b* is slidably received within and along upper assembly 16, such that left handle slide 18*b* is slidable along the x-axis of device 10. This will become clearer as this specification continues. Left compliant handle assembly 20*b* is coupled to left handle slide 18*b* and extends proximally from left handle slide 18*b* substantially along the y-axis of device 10, substantially perpendicular to the longitudinal axis of slide rails 13 (see left compliant handle assembly component 20*b*') and then inwardly toward base 12 (see left compliant handle assembly component 20*b*"). Left handle 21*b* is rigidly coupled to the free end of left compliant handle assembly 20*b* to permit a large range of left arm movement.

Spring stack 28*c* can be positioned at the connection point between left handle slide 18*b* and left compliant handle assembly 20*b*. Spring stack 28*d* can be positioned at the joint or connection point between left compliant handle assembly component 20*b*' and left compliant handle assembly component 20*b*". Spring stacks 28*c*, 28*d* will become clearer as this specification continues.

Figure 6:
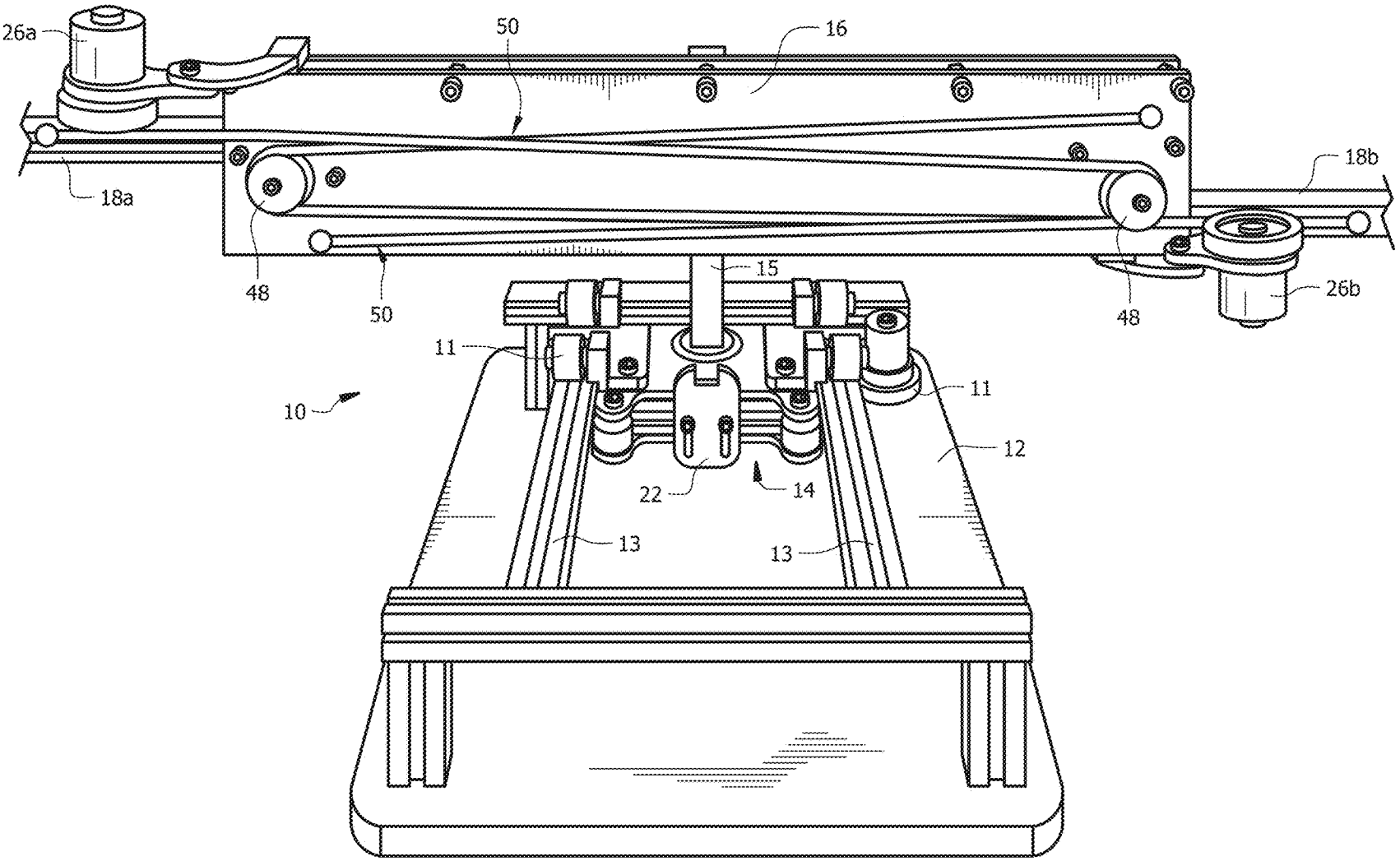
FIG. 6 is a rear perspective view of a compliant bimanual rehabilitation device according to an embodiment of the current invention.

Locking mechanism 22 (seen best in FIG. 6 as a locking plate) provides a configuration, when actuated, for the JSS and VS modes, which use movement along the x- and y-axes. Actuating locking mechanism 22 (or presence of locking plate 22, as seen in FIG. 6) restricts movement/rotation of upper assembly 16 in the z-axis. Thus, for the JSS and VS modes, right handle slide 18*a* and left handle slide 18*b* are capable of moving in the x-direction, along with movement of carrier assembly 14, upper assembly 16, right handle slide 18*a*, and left handle slide 18*b* in the y-direction, but no rotational movement of any structure in the z-direction since movement should only be in the x- and y-directions for these modes. If locking plate 22 is removed, rotation is permitted.

In turn, locking mechanism 24 provides a configuration, when actuated, for the PMS mode, which uses movement of upper assembly 16 along the z-axis. Actuating locking mechanism 24 restricts movement of upper assembly 16 in the y-axis. Thus, for the PMS mode, right handle slide 18*a* and left handle slide 18*b* are capable of moving in the x-direction, along with movement of carrier assembly 14, upper assembly 16, right handle slide 18*a*, and left handle slide 18*b* in the z-direction, but no linear movement of carrier assembly 14 or upper assembly 16 in the y-direction since movement should only be in the x- and z-directions for this mode.

Figure 11A:
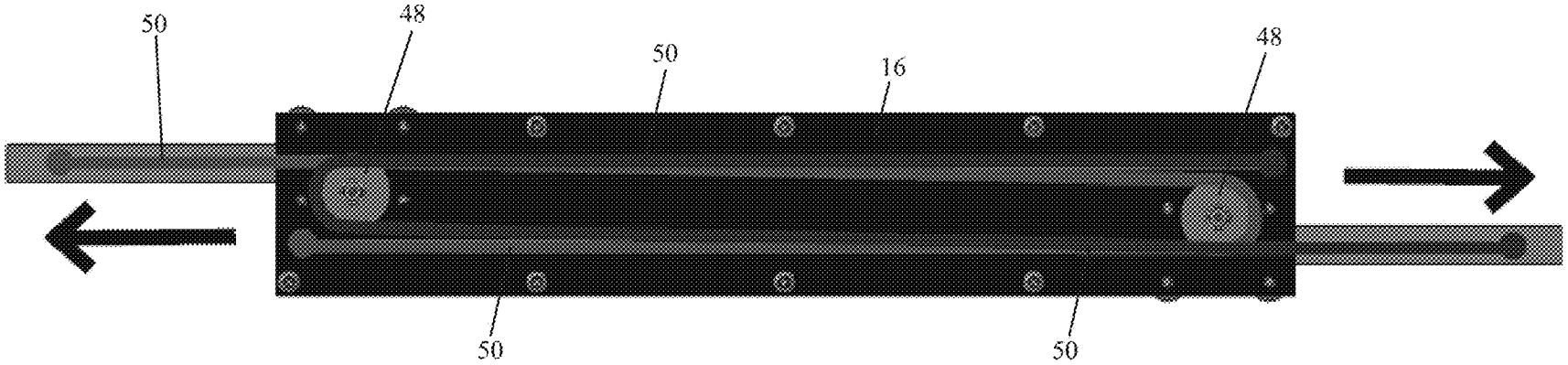
FIGS. 11A-11B are diagrams of cable layouts as viewed from the rear of a compliant bimanual rehabilitation device according to an embodiment of the current invention. Cable runs are indicated by the horizontal lines, attached to the handle slides at their ends.
Figure 11B:
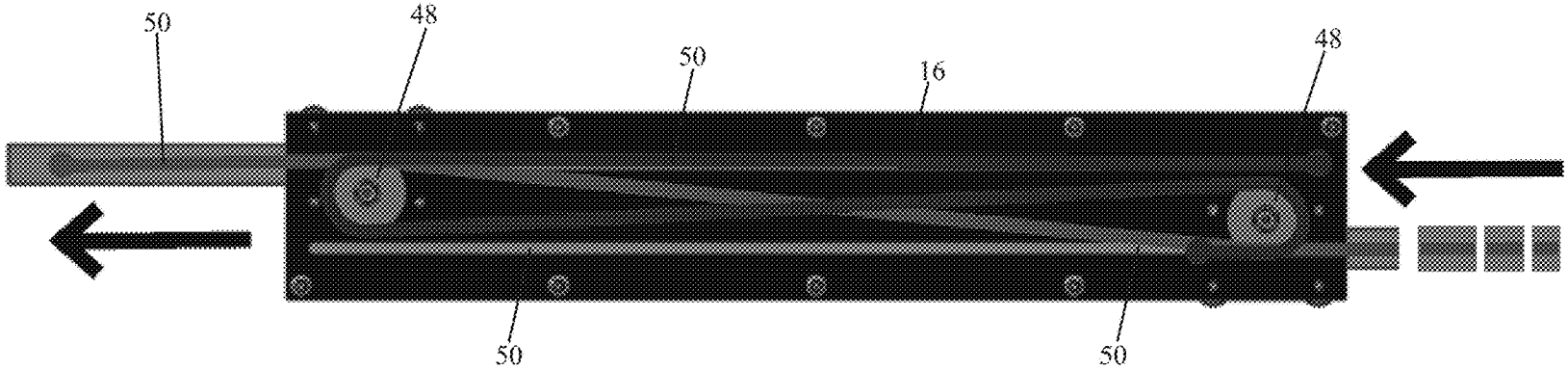

Control of handle slides 18*a*, 18*b* can be achieved using knobs or pulleys 48 and cable(s) 50, as can be seen in FIGS. 6, 11A, and 11B. This will become clearer as this specification continues.

Figure 4:
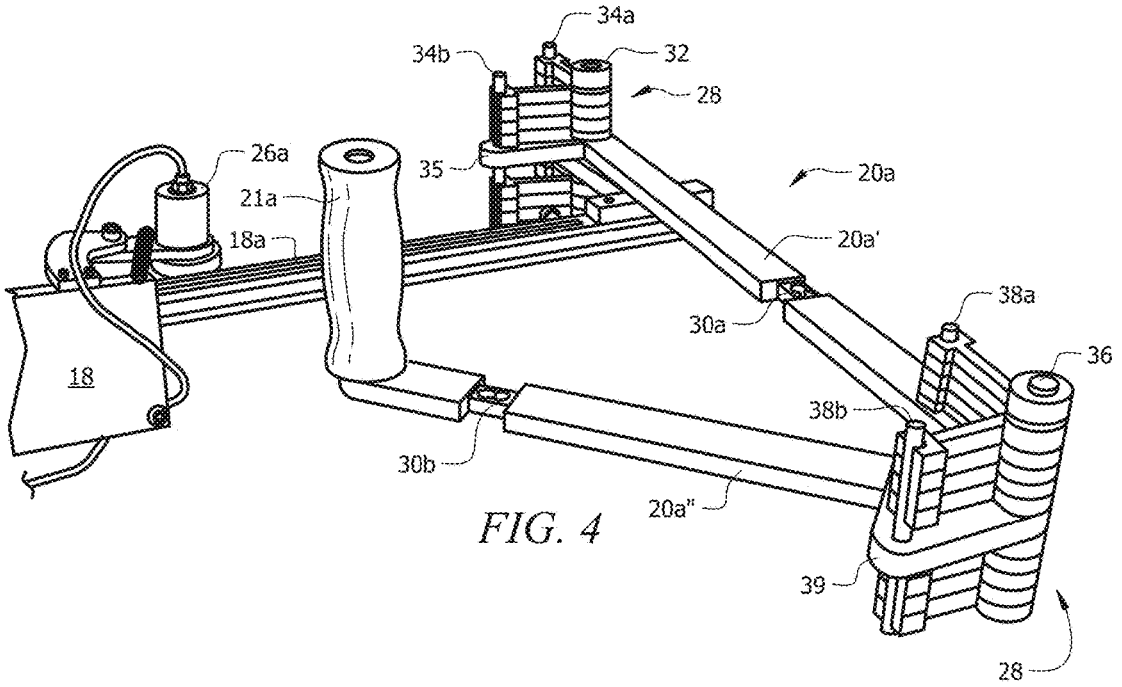
FIG. 4 is a close-up perspective view of a compliant handle assembly (right compliant handle assembly in this figure) according to an embodiment of the current invention.

As can be seen most clearly in FIG. 4, right encoder 26*a* is disposed in a fixed position on and in communication with right handle slide 18*a* in order to determine the position of right handle slide 18*a* (along the x-axis). Encoder 26*a* can be angular, linear, positional, or other suitable mechanism for determining the position of right handle slide 18*a* and converting that position to an analog or digital code potentially for transmission to an electronic or computing device.

Similarly, as can be seen most clearly in FIG. 6, left encoder 26*b* is disposed in a fixed position on and in communication with left handle slide 18*b* in order to determine the position of left handle slide 18*b* (along the x-axis). Encoder 26*b* can be angular, linear, positional, or other suitable mechanism for determining the position of left handle slide 18*b* and converting that position to an analog or digital code potentially for transmission to an electronic or computing device.

Front encoder 26*c* is disposed in a fixed position on and in communication with carrier assembly 14 in order to determine the position of carrier assembly 14 (along the y-axis). Encoder 26*c* can be angular, linear, positional, or other suitable mechanism for determining the position of carrier assembly 14 and converting that position to an analog or digital code potentially for transmission to an electronic or computing device.

Figure 7A:
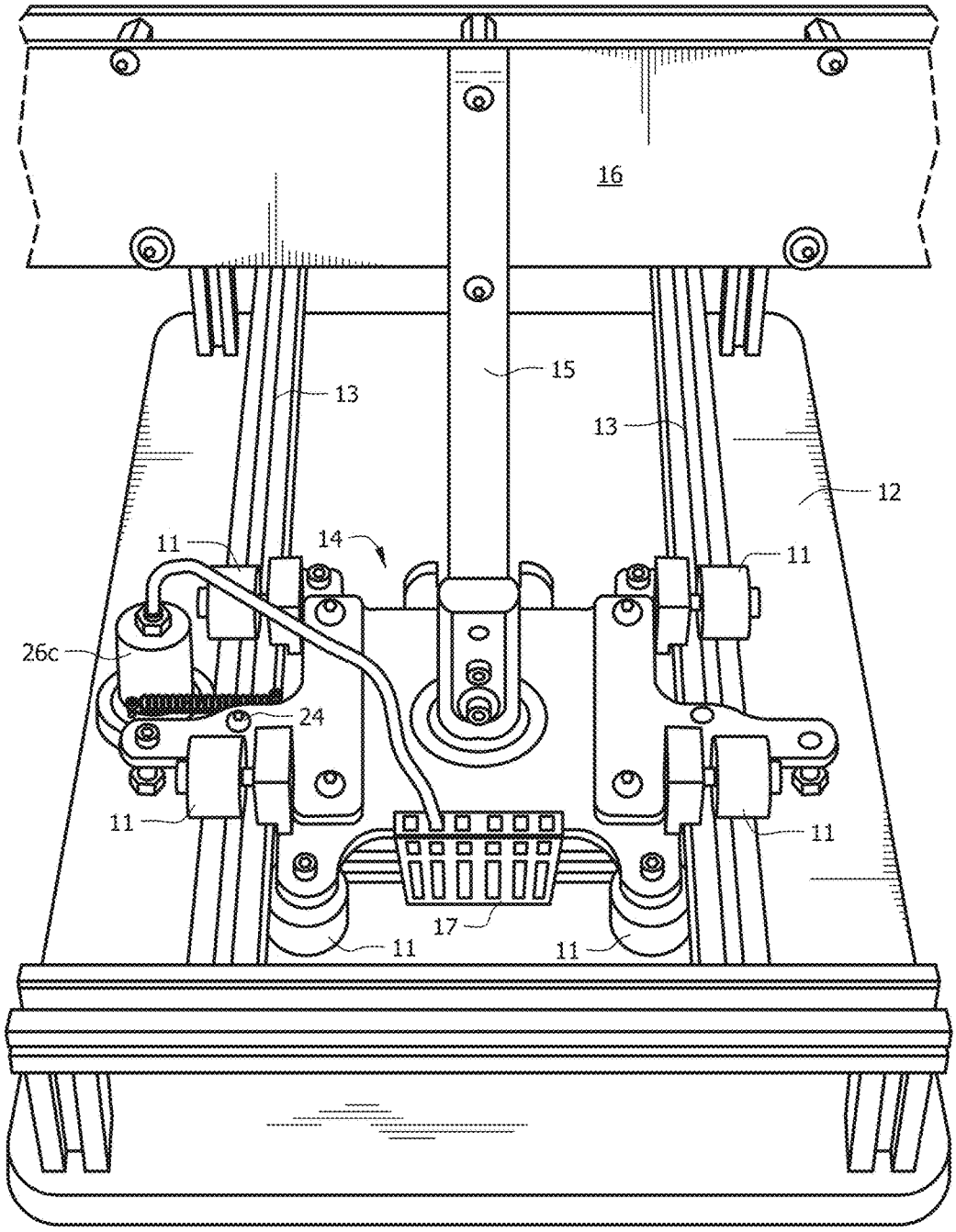
FIG. 7A is a close-up view of a carrier assembly in a compliant bimanual rehabilitation device according to an embodiment of the current invention.
Figure 7B:
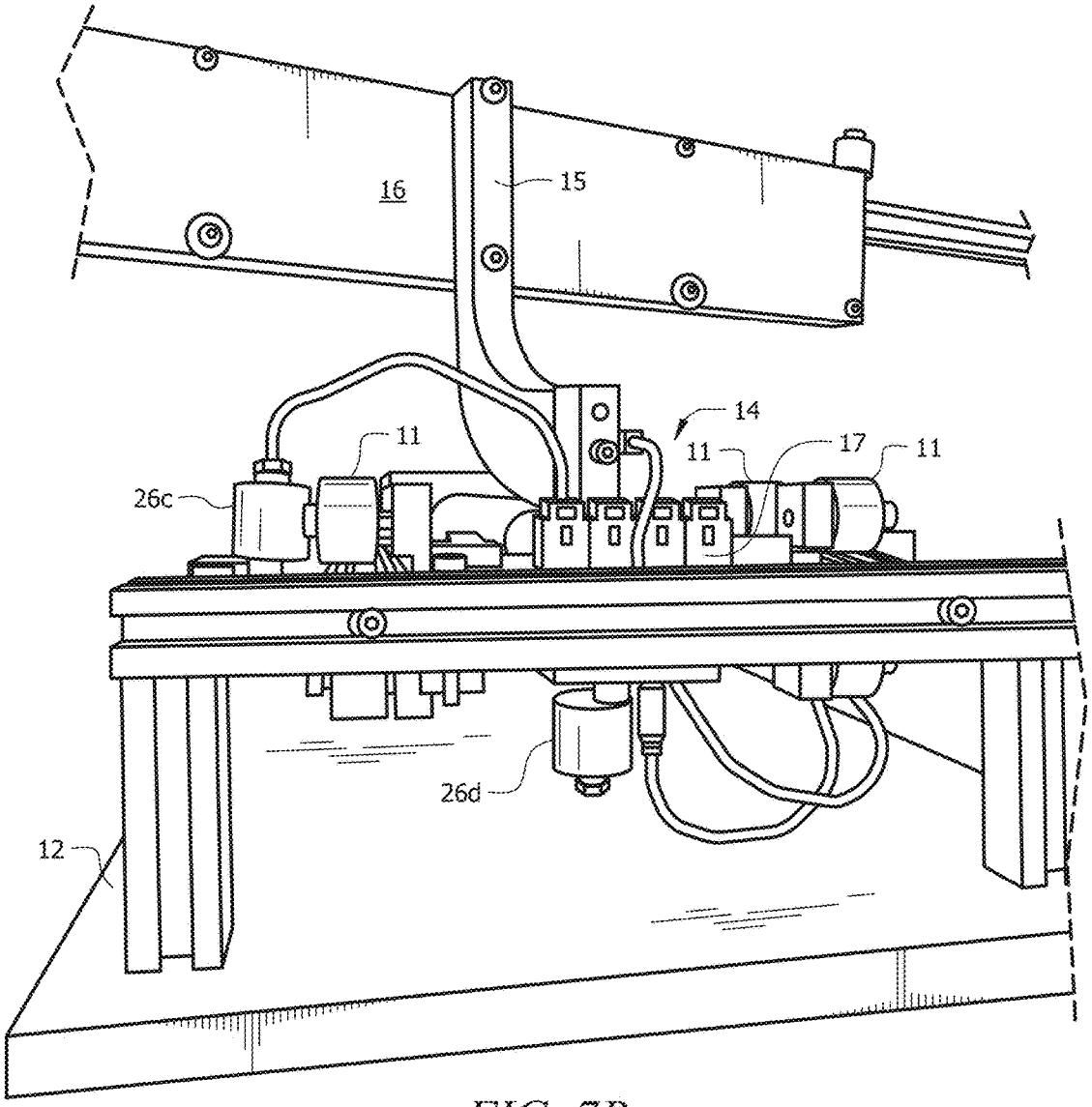
FIG. 7B is a lower elevation view beneath the carrier assembly of FIG. 7B, showing the lower encoder.

Optionally, as indicated in FIGS. 7A-7B, lower encoder 26*d* can be fixedly positioned and in communication with upper assembly 16 in order to determine a position of upper assembly 16 in the z-axis. Encoder 26*d* can be angular, linear, positional, or other suitable mechanism for determining the position of upper assembly 16 and converting that position to an analog or digital code potentially for transmission to an electronic or computing device.

Optionally, to measure the force used by a user of device 10 on device 10 during rehabilitation, one or more load cells can be positioned right compliant handle assembly 18*a* and/or on left compliant handle assembly 18*b*. For example, load cell 30*a* can be positioned along an extent of right compliant handle assembly component 20*a*' of right compliant handle assembly 20*a*, and load cell 30*b* can be positioned along an extent of right compliant handle assembly component 20*a*" of right compliant handle assembly 20*a*.

Similarly, load cell 30*c* can be positioned along an extent of left compliant handle assembly component 20*b*' of left compliant handle assembly 20*b*, and load cell 30*d* can be positioned along an extent of right compliant handle assembly component 20*b*" of left compliant handle assembly 20*b*. Load cells 30*a*-30*d* permit a therapist to monitor the amount of force placed upon said load cells 30*a*-30*d* in order to track progression of a paretic limb. As such, load cells 30*a*-30*d* may be electronically coupled to an electronic or computing device.

Device 10 may process the information/data received from encoders 26*a*-26*c* and load cells 30*a*-30*d* and communicate with the electronic or computing device via circuit board 17 or other suitable methodology.

The amount of force needed for the user's sound and paretic limbs to move right compliant handle assembly 18*a* and left compliant handle assembly 18*b* using right handle 21*a* and left handle 21*b*, respectively, in the prescribed pattern (e.g., JSS, VS, PMS) can be adjusted via spring stacks 28. Each spring stack 28 can be a singularly formed spring or formed of a plurality of springs, for example torsion spring 40 seen in FIG. 5.

FIG. 4 specifically shows right handle slide 18*a* and right compliant handle assembly 20*a*, both of which having structures that are symmetrical with left handle slide 18*b* and left compliant handle assembly 20*b*. Thus, it should be understood that a description of more specific structures of right handle slide 18*a* and right compliant handle assembly 20*a* would be substantially similar and relevant to left handle slide 18*b* and left compliant handle assembly 20*b*.

Right compliant handle assembly component 20*a*' has a proximal end and a distal end, relative to a user of device 10. On both its proximal end and its distal end, right compliant handle assembly component 20*a*' includes spring stack 28. Spring stack 28 can be coupled to right compliant handle assembly component 20*a*' in any suitable way. For example, center post 32 and peripheral posts 34*a*, 34*b* can be positioned on the distal end of right compliant handle assembly component 20*a*' on distal base 35. Similarly, center post 36 and peripheral posts 36*a*, 36*b* can be positioned on the proximal end of right compliant handle assembly component 20*a*' on proximal base 39. Peripheral posts 34*a*, 38*a* can be positioned substantially in line with the longitudinal extent of right compliant handle assembly component 20*a*', and peripheral posts 34*b*, 38*b* can be positioned substantially normal to the longitudinal extent of right compliant handle assembly component 20*a'*.

Figure 5:
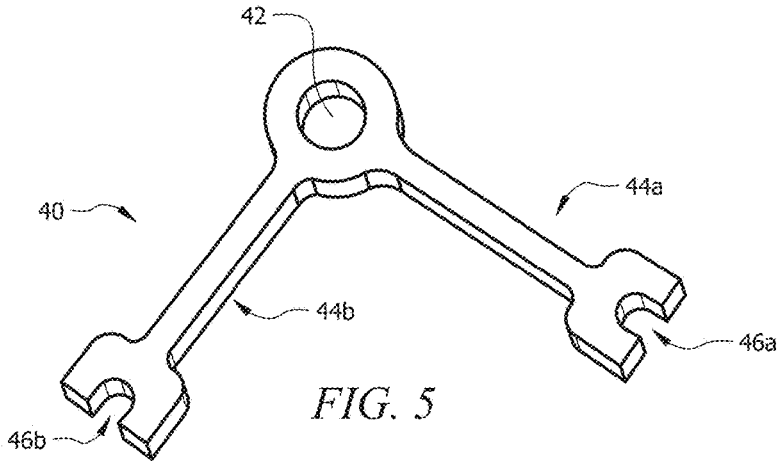
FIG. 5 depicts an exemplary spring that may be used in a compliant handle assembly according to an embodiment of the current invention.

As briefly noted previously, spring stack 28 may be formed of a plurality of springs, such as a plurality of torsion springs, one of which is indicated generally by reference numeral 40 in FIG. 5, though any suitable torsion spring may be used. In this example, torsion spring 40 includes center aperture 42 and forks 44*a*, 44*b* with channels 46*a*, 46*b*, respectively, between the respective tines of forks 44*a*, 44*b*.

Center posts 32, 36 are structured to be inserted through center aperture 42 of each torsion spring 40 (i.e., the inner diameter of center aperture 42 is larger than the outer diameter of center posts 34*a*, 34*b*). Center posts 32, 36 and center aperture 42 can have any suitable corresponding shape or size.

Peripheral posts 34*a*, 34*b* are structured to be positioned within channels 46*a*, 46*b* of respective forks 44*a*, 44*b* of each torsion spring 40 (i.e., the inner length of channels 46*a*, 46*b* is larger than the outer diameter of peripheral posts 34*a*, 34*b*). Channels 46*a*, 46*b* and peripheral posts 34*a*, 34*b* can have any suitable shape or size. Similarly, peripheral posts 38*a*, 38*b* are structured to be positioned within channels 46*a*, 46*b* of respective forks 44*a*, 44*b* of each torsion spring 40 (i.e., the inner length of channels 46*a*, 46*b* is larger than the outer diameter of peripheral posts 38*a*, 38*b*). Channels 46*a*, 46*b* and peripheral posts 38*a*, 38*b* can have any suitable shape or size.

Figure 3:
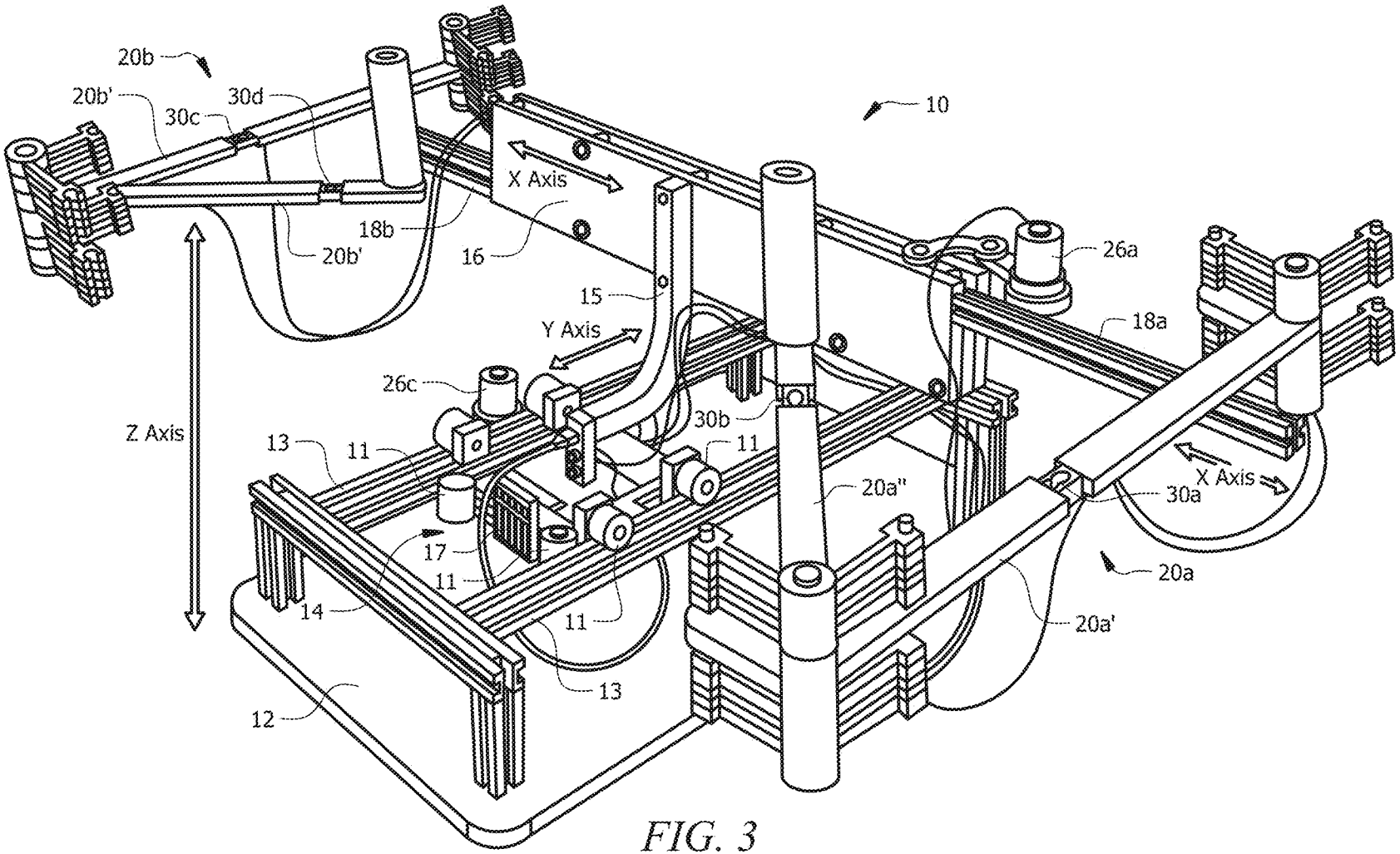
FIG. 3 is a right corner perspective view of a compliant bimanual rehabilitation device according to an embodiment of the current invention.

In certain embodiments, as seen in FIGS. 2-4, spring stack 28 can be positioned both above and below distal base 35. In this case, particularly if spring stack 28 is formed of a plurality of torsion springs 40, any or all of center post 32 and peripheral posts 34*a*, 34*b* can be disposed through distal base 35, such that torsion springs 40 can be secured above distal base 35 and below distal base 35. Similarly, spring stack 28 can be positioned both above and below proximal base 39. In this case, particularly if spring stack 28 is formed of a plurality of torsion springs 40, any or all of center post 36 and peripheral posts 38*a*, 38*b* can be disposed through proximal base 39, such that torsion springs 40 can be secured above proximal base 39 and below proximal base 39. Torsion springs 40 can be secured using any suitable mechanism, such as a lock or stopper.

As can be seen in FIG. 4 in view of FIG. 5, one of forks 44*a*, 44*b* of torsion spring 40 may be positioned substantially parallel to the longitudinal extent of right compliant handle assembly component 20*a*', and the other of forks 44*a*, 44*b* of torsion spring 40 may be positioned substantially normal to the longitudinal extent of right compliant handle assembly component 20*a'*.

As can be understood by one of ordinary skill in the art, the number of torsion springs 40 used can be altered, thus adjusting the amount of force needed to be expended by a user of device 10 in order to perform the rehabilitation program. It is also contemplated herein that spring stack 28 and torsion springs 40 are not needed at all in device 10, as the amount of force needed in the rehabilitation program can be adjusted in a variety ways, such as with magnets, computerized adjustment, real-time or even automated adjustment, etc.

FIG. 6 is a rear view of upper assembly 16, particularly depicting knobs or pulleys 48 and cable 50 that control handle slides 18*a*, 18*b* along the x-axis. As can be seen, cable 50*a* is attached to right handle slide 18*a*, and cable 50*b* is attached to left handle slide 18*b*. A diagram of this mechanism can also be seen in FIGS. 11A-11B. Altering the path of cable 50 changes the coupling of handle slides 18*a*, 18*b* to each other and thus controls how they may move relative to each other in the x-direction. If cable(s) 50 loops around pulleys 48 an odd number of times, the motions of handle slides 18*a*, 18*b* are mirrored to each other, for example as necessary for the JSS and PMS modes (see FIGS. 6 and 11A). If cable(s) 50 loops around pulleys 48 an even number of times, handle slides 18*a*, 18*b* move in the same absolute direction, for example as required for the VS mode (see FIG. 11B).

Figure 8A:
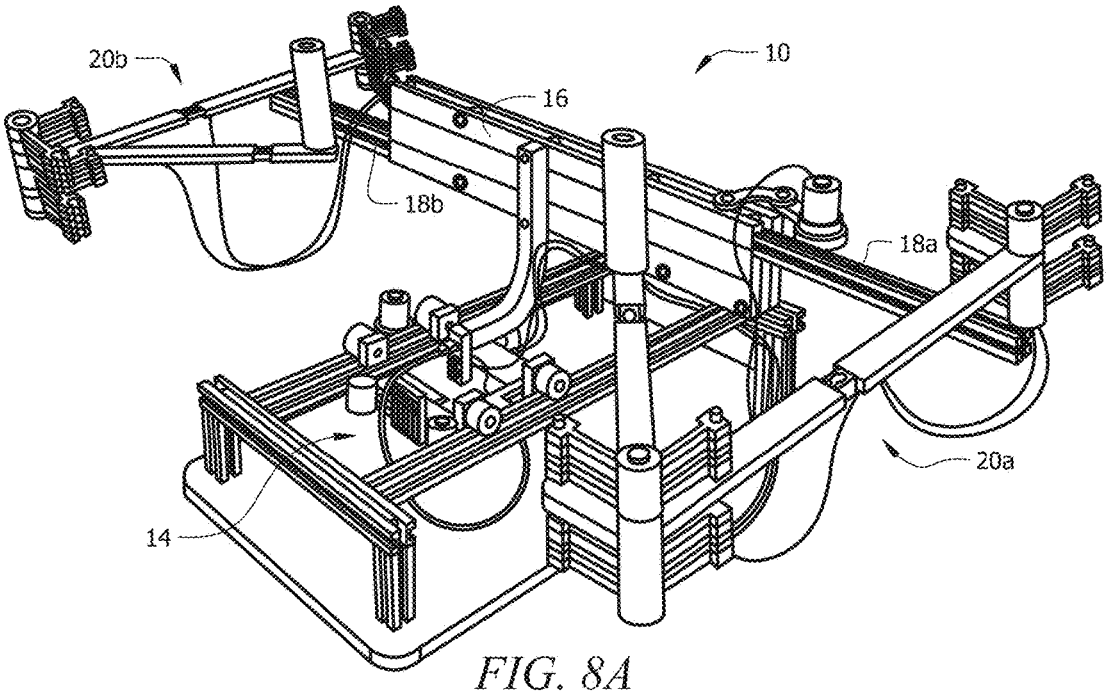
FIG. 8A shows the compliant handle slide in an expanded position along the x-axis.
Figure 8B:
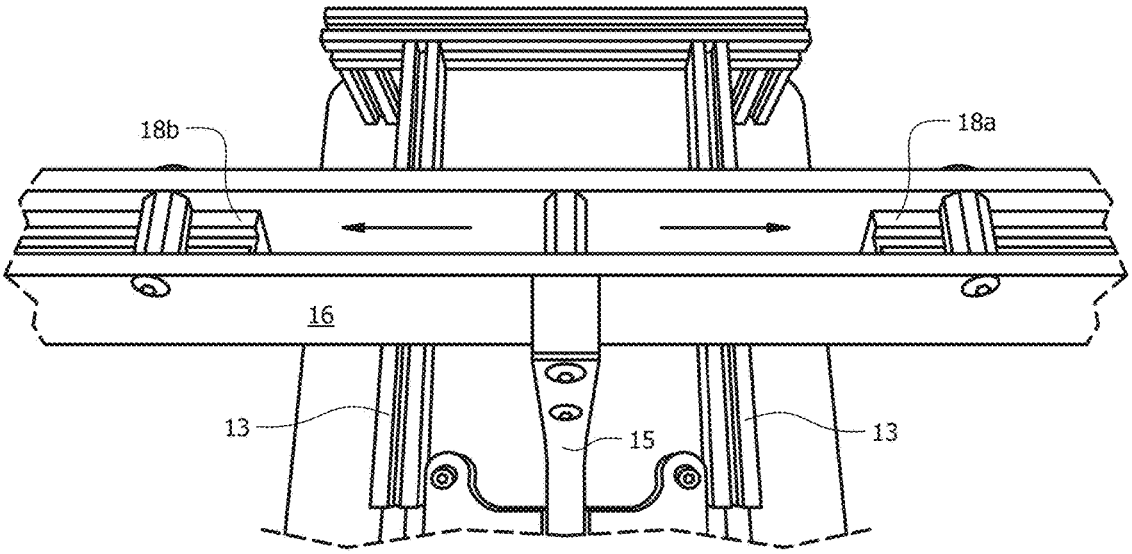
FIG. 8B shows disposition of the compliant handle slides within the upper assembly when in the expanded position of FIG. 10A.

Referring back to the movement of right handle slide 16*a* and left handle slide 16*b* in the x-direction, FIGS. 8A-8B show handle slides 18*a*, 18*b* in an expanded position, and FIGS. 9A-9B show handle slides 18*a*, 18*b* in a contracted position. In particular, FIGS. 8B & 9B depict how handle slides 18*a*. 18*b* slide past one another (e.g., side by side, above and below, one within the other, etc.) within upper assembly 16.

By physically coupling the sound and paretic limbs, an individual with hemiparesis would be able to move his impaired hand through motions he would not otherwise be able to make while still allowing him complete control over the motion generated. This method also allows for upper-limb rehabilitation devices that are significantly lower in cost than robotic systems since much of the required force could be provided by the patient's healthy limb instead of the larger motors included on many current upper-limb rehabilitation robots. This would result in a lower cost and safer rehabilitation method that could be used at home, increasing access to rehabilitation. The hands may be coupled in one of several symmetry modes, as seen in FIG. 1, though other symmetry modes are contemplated by the current invention as well.

Example

Coupling System

The coupling system includes a four-jointed mechanism with three prismatic joints and one revolute joint. The first joint, hereafter referred to as the Y-axis joint, is prismatic and connects the base 12 to a captive carrier assembly 14 that supports the remainder of device 10, allowing for motion towards or away from the human subject or participant for both JSS and VS modes. Bolt, lock, or other locking mechanism 24, for example with a captive nut, is used to remove this degree of freedom for PMS. The second joint, in the center of carrier assembly 14, is revolute and connects carrier assembly 14 to upper assembly 16 and allows the latter to rotate for PMS. This joint can be referred to as the Z-axis joint. Locking mechanism 22, such as a locking plate, removes this degree of freedom for JSS and VS symmetry modes.

The motion of the Y-axis joint can be monitored by encoders 26*a*, 26*b* (e.g., optical) with an angular resolution of 0.25°. Encoders 26*a*, 26*b* contact right handle slide 18*a* and left handle slide 18*b*, respectively, with friction wheels of radius 2.38 mm, resulting in a linear resolution of 0.10 mm. Similarly, the Z-axis angle can be monitored by encoder 26*c* (e.g., optical) with a resolution of 0.25°.

The third and fourth joints described herein allow for lateral motion of handle slides 18*a*, 18*b* in JSS and VS and for radial motion in PMS. The motion of these X-axis joints can be monitored by encoders 26*a*, 26*b* with an angular resolution of 0.25°. Encoders 26*a*, 26*b* contact handle slides 18*a*, 18*b* with friction wheels of radius 2.38 mm, resulting in a linear resolution of 0.10 mm.

The motions of the third and fourth joints are coupled by cable runs (see FIGS. 6 & 11A-11B) on the rear side of upper assembly 16. As shown in FIGS. 11A-11B, altering the path of cable 50 changes the coupling. If cable 50 loops around pulleys 48 an odd number of times, the motions of handle slides 18*a*, 18*b* are mirrored, as necessary for JSS and PMS (FIG. 11A). If cable 50 loops around pulleys 48 an even number of times, handle slides 18*a*, 18*b* move in the same absolute direction, as necessary for VS (FIG. 11B).

In JSS and VS, each handle has a workspace 330 mm deep and 431 mm wide, starting 124 mm from the centerline. In VS, the distance between the handles is 679 mm, so that the maximum extension for one handle is the minimum extension for the other. In PMS, the workspace is a disk with an inner radius of 124 mm and an outer radius of 555 mm. At full extension in JSS or PMS, the handles are 1110 mm apart.

The stiction in the joint formed of base 12 to carrier assembly 14 is approximately 4-20 N, though typically less than 10 N, dependent on the extension of handle slides 18*a*, 18*b* and the resultant torque applied to the joint. The resistance in the joint formed of carrier plate 14 and upper assembly 16 is negligible. The stiction in the joint formed of upper assembly 16 to handle slides 18*a*, 18*b* is approximately 10-15 N. The total mass of the carrier and all moving components is 6.9 kg. It is contemplated that stiction and weight can be further reduced as well.

Compliant Handle Assembly

Each handle 21*a*, 21*b* is connected to the coupling system by compliant handle assemblies 18*a*, 18*b*, respectively, that provides a restoring force towards the correct position or otherwise forces handle 21*a*, 21*b* towards the correct position, but allows handle 21*a*, 21*b* to deviate from this correct position. Each compliant handle assembly 18*a*, 18*b* includes three links (compliant handle assembly components 20*a*', 20*a*". 20*b*', 20*b*" are seen), connected by two pins (center posts 32, 36), and spring stacks 28*a*-28*d*, formed of a stack of torsion springs 40 on each pin 32, 36. Springs 40 each include an L-shaped piece of acetal plastic, 51 mm per leg (see reference numeral 44*a*, 44*b*), with center aperture 42 for connecting center post 32, 36 where the legs meet.

Torsion spring 40 was customized for device 10 and may optionally be used, as standard torsion springs are typically designed for larger deflections than used herein. To achieve the same stiffness, standard springs require more material, substantially increasing the size and weight. Torsion spring 30 also allows for more control over the stiffnesses implemented. The performance of torsion springs 40 was confirmed to be linear over the range used. It is, however, contemplated herein that any suitable spring(s) may be used with device 10.

In each of compliant handle assemblies 20*a*, 20*b*, the second and third links make up the hypotenuse (see compliant handle assembly components 20*a*", 20*b*") and one leg (see compliant handle assembly components 20*a*'. 20*b*'), respectively, of a 45°-45°-90° triangle, with handle 21*a*, 21*b* at the 90° corner. This results in the torques about center posts/pins 32, 36 producing a symmetric stiffness ellipse at respective handles 21*a*, 21*b*, for small deflections, although large deflections will result in distorted stiffness ellipse. It is contemplated that the shape of the stiffness ellipse can be optimized accordingly.

Figure 12:
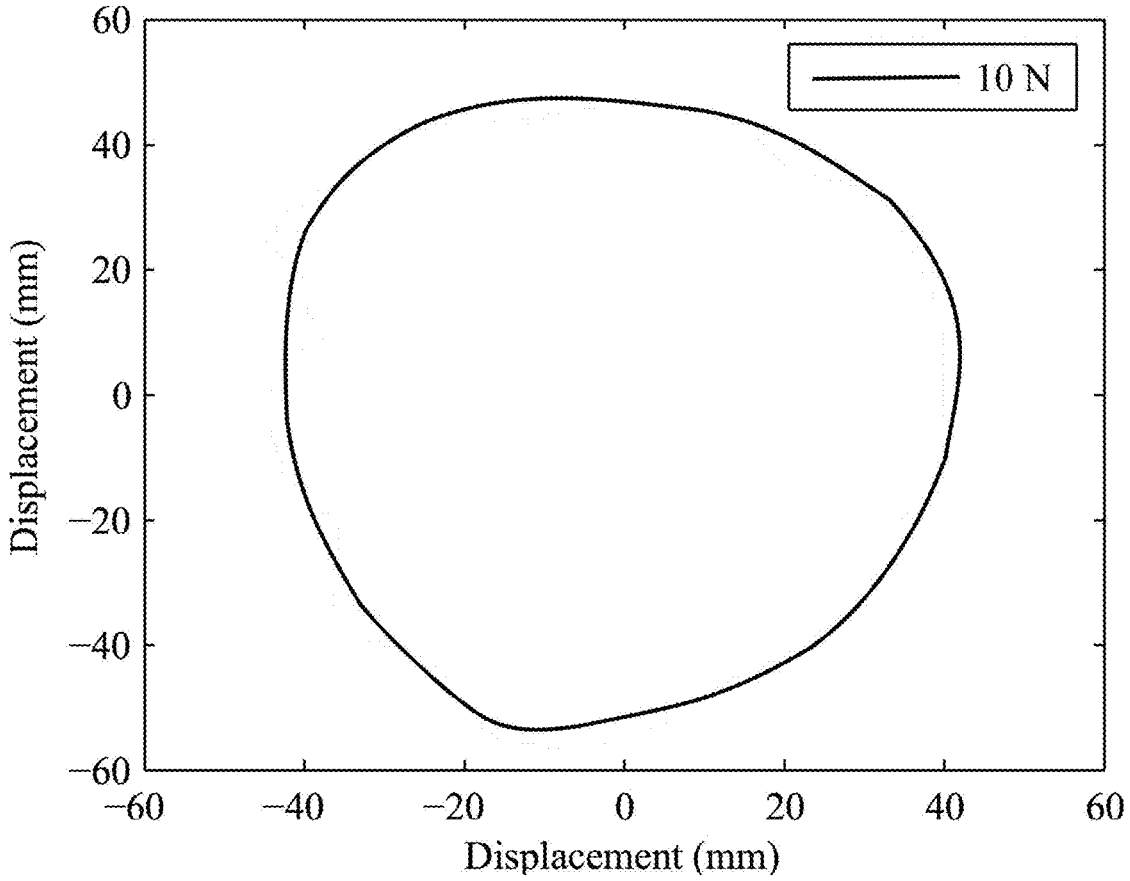
FIG. 12 depicts the compliant handle assembly stiffness ellipse.

Each of compliant handle assemblies 20*a*, 20*b* can be designed for a maximum deflection of 75 mm in any direction. For this deflection, the maximum width of each torsion spring 40 is 6 mm, hence a stack of torsion springs 40 with 6.4 mm thickness is used to achieve higher stiffnesses. Each spring 40 adds 110 N/m to the stiffness of the respective connections between handles 21*a*, 21*b* and handle slides 18*a*, 18*b*; however, since both handles 21*a*, 21*b* are connected in this way, the overall coupling stiffness added by each set of springs 40 is 55 N/m, and the maximum combined deflection from correct coupled positions is 150 mm. The stiffness ellipse for one of handles 21*a*, 21*b* with two of springs 40 is shown in FIG. 12.

The forces in the links are monitored by shear load cells 30*a*-30*d*. From the load cell readings, the force on each of handles 21*a*, 21*b* can be calculated, and given a known joint stiffness, based on the number of springs 40 used, the joint deflection can be calculated, along with the position of handles 21*a*, 21*b*.

Display and Interaction Game

An individual/user/operator interacts with CBRD device 10 by grasping right handle 21*a* and left handle 21*b* and moving them to desired positions as displayed on a monitor/display screen, as seen in FIG. 10. The motion along the x-axis is coupled by a cable system (formed of pulleys 48 and cables 50) on the back of upper assembly 16. Handles 21*a*, 12*b* are connected to handle slides 18*a*, 18*b* by compliant handle assemblies 20*a*, 20*b* with spring stacks 28 at the joints, where spring stacks 28 are formed of torsion springs 40.

The workspace of the CBRD device can be visually represented on a display located above and slightly behind the device to allow users to interact with visually displayed targets. The displayed workspace was scaled down by a factor of 2.5:1, resulting in a visual workspace area that is about 132 mm tall and about 442 mm wide. For consistency, unless otherwise noted, all non-limiting dimensions given are for the physical workspace. Desired/Target positions of the right and left handles are presented in FIG. 10 as the outer circles/dots, which are about 40 mm (16 mm displayed) in diameter. As seen in FIG. 10, the right and left handles are displayed as the inner circles, respectively, with both being about 40 mm in diameter, and the desired/target positions are indicated as the outer circles.

For the studies presented herein, the task that participants were asked to complete included matching the handle position(s) with the desired/target position(s). Each trial included a series of eighteen (18) segments, beginning with the display of randomly generated desired/target positions. The segment would end, and after a brief delay, the desired position would shift to a new position if the handle position was within about five (5) mm of the desired/target position or if about fifteen (15) seconds had elapsed since the desired/target position was first displayed.

The CBRD device allows for the study of the effect of coupling stiffness and symmetry on the efficacy of bimanual rehabilitation, as well as the performance of other bimanual tasks. This device could be used to fulfill the need for a low-cost home use rehabilitation device that is suitable for patients with varying degrees of impairment.

Study/Experiment

The study presented herein describes the design and preliminary analysis of a device that permits testing of the efficacy of different coupling stiffnesses and symmetry modes in bimanual rehabilitation.

To evaluate the effectiveness of the device at coupling hand motions, a series of studies were conducted. The eventual goal is stroke rehabilitation and in particular to quantify the performance of the device when one hand applies minimal input to the system: here, two people were used to mimic the lack of bimanual coordination that occurs in individuals with stroke. The guiding participant could see the handle and desired positions; the following participant was blindfolded and could only feel the motions. This is a harsher test since the two participants are completely uncoupled neurally whereas an individual with stroke can couple the motions, but cannot fully control one of the arms. Thus, the device was evaluated in both a dual and single participant study.

Two Participant Study

The purpose of this study was to quantify the performance of the device when one hand applies minimal input to the system. The guiding participant could see the handle and desired positions, while the following participant was blindfolded and could only feel the motions. Performance was compared under the following conditions Two Person-Guiding Visible (2P-GV): The guiding participant must place his handle in the target area Two Person-Following Visible (2P-FV): The guiding participant must place the follower's handle in the target area.

In the dual-participant study, two participants stood in front of the device and each grasped a handle. The participant on the right held the right handle and the participant on the left held the left handle, mimicking the way that it would be held by a person with a stroke during rehabilitation. For each trial, one participant was designated as the guiding participant and the other participant was considered the following participant. The desired positions and handle positions were only displayed to the guiding participant and the following participant was asked to close their eyes or use a blindfold. A curtain separated the participants so that the guiding participant could only see their side of the device and the computer screen. The purpose of the two participant study was to quantify the performance of the device when one hand applies minimal input to the system.

The participants were asked to complete two types of tasks in different coupling symmetry modes and with different coupling stiffnesses. The symmetry modes tested were JSS and VS; PMS was omitted because it has been shown to be more difficult to coordinate bimanual motions in [19] and to limit the total study time to 1 hour to reduce the possibility of participant fatigue. The coupling stiffnesses tested were 110 N/m and 380 N/m. The lower stiffness was selected to be between 50 N/m and 200 N/m since this was shown to be an area of transition in path perception accuracy [19]. The 380 N/m coupling stiffness was selected as the highest possible stiffness without reducing the compliant workspace area below the maximum diameter of 300 mm.

In one task, hereafter referred to as Two Person-Guiding Visible (2P-GV), only the guiding participant's desired and handle position were displayed, where the guiding participant must place his handle in the target area. For this task, the guiding participant was asked to match their handle position with the desired position as quickly as possible. In the other task, hereafter referred to as Two Person-Following Visible (2P-FV), the following participant's desired position and both handle positions were displayed, where the guiding participant must place the following participant's handle in the target area. For this task, the guiding participant was asked to match the following participant's handle position with the desired position.

Both participants completed all combinations of symmetry mode, stiffness and task type twice, once as the guide and once as the follower. The overall order of symmetry mode, stiffness, task and guiding participant was randomized for each pair of participants. However, to avoid confusion, and reduce delay time from switching configurations, the trials for each coupling stiffness were presented together. Similarly, for each coupling stiffness, all of the trials for one symmetry mode were presented before changing the symmetry mode, and for each symmetry mode, one guiding participant completed both tasks before the guiding participant was changed. Ten participants performed this study with IRB approval: eight were male, all were right handed, age 21-61 years old.

Single Participant Study

The purpose of this study was to analyze the effect of the CBRD on assisting a healthy participant in coordinating their hand motions. Performance was compared under the following conditions One Person-Single Visible (1P-SV): Only one of the sets of handle and desired positions are shown.

One Person-Both Visible (1P-BV): Both sets of handle and desired positions are shown.

One Person-Distorted Positions (1P-DP): Both sets of handle and desired positions are shown, and the desired positions are distorted from their symmetric locations.

In this study, a single participant stood in front of the device and held both handles. The participants were asked to complete three types of tasks in different coupling symmetry modes and with the handles of the device in one of two coupling conditions: either physically coupled in the desired symmetry mode, or uncoupled where the handle positions are not physically coupled. The symmetry modes tested were the same as those tested in the two participant study. When the handles were coupled, a coupling stiffness of 380 N/m was used for consistency with the two participant study.

For the physically coupled trials, the device was locked in the desired symmetry mode. To uncouple the handles, neither the Y nor Z-axis joints were locked, allowing the handles to be positioned independently, anywhere in the device workspace, however, they were dynamically coupled by inertia and friction, and the handles would still twist by the same angle about the Z-axis. In the uncoupled trials, participants were instructed to couple their hand motions in the desired symmetry mode.

One task was identical to that of the two participant study. In this task, referred to as One Person-Single Visible (1P-SV), participants were asked to match one handle position to a desired position as quickly as possible, while moving both of their hands together in the desired symmetry mode. In another task, referred to as One Person-Both Visible (1P-BV), both left and right handle and desired positions were displayed in the current symmetry mode, and participants were asked to match both handle positions to the desired positions. The purpose of these tasks was to analyze the effect of the CBRD on assisting a healthy participant in coordinating their hand motions.

In the third task, referred to as One Person-Distorted Positions (1P-DP), both left and right handle and desired positions were displayed, but their positions from the zero position for the symmetry mode were distorted by a factor of 1:1.5, and participants were, again, asked to match both handle positions to the desired positions. The purpose of this task was to mimic the decreased perceptional ability of individuals with stroke and test the device's ability to transmit forces.

Participants completed all combinations of symmetry mode, coupling condition and task twice; 1P-SV was completed once with the left visible and once with the right visible, and similarly 1P-DP was completed once with the distortion on the left and once with the distortion on the right. The 1P-BV condition was simply completed twice under the same conditions.

The overall order of symmetry mode, coupling condition, task, and left or right display/distortion was randomized. However, to avoid confusion, and reduce delay time from switching configurations, the trials for each symmetry mode were presented together. Similarly, for each symmetry mode, all of the trials for one coupling condition were presented before changing the coupling condition. If the first trial that a participant would conduct in a new symmetry mode was uncoupled, and only one desired position displayed, i.e. they would have neither visual nor haptic indication of how to couple their hand motions, they were permitted to practice moving in the desired symmetry mode until they understood the correct way to couple their motions. Six participants performed this study with IRB approval, five were male, and all were right handed, age 21-25.

Analysis

To quantify performance during a trial, the average completion time and the average coupled position error were analyzed. The average completion time for a trial was determined by calculating the average segment time, from the display of a desired position or positions to the matching of the handle position(s) with the desired position(s), and averaging these segment times for each trial. The average coupled position error was the average, for a trial, of the distance between the right handle position and the projected symmetric position of the left handle at the end of each segment. The projected symmetric position of the left handle was determined by mirroring the position of the handle for JSS mode or adding 679 mm to the left handle position for VS mode.

For statistical analysis, an analysis of variance (ANOVA) was conducted to analyze the effects of symmetry mode, coupling stiffness or condition, task type and guiding side on the average completion time and average coupling position error. When the ANOVA yielded significant results, Tukey's honestly significant difference test was used. An alpha of 0.05 was used for all statistical tests.

Results—Two Participant Study

Since the two types of tasks in the dual-participant study are inherently different: moving a handle directly vs. moving a handle through the coupling of the device, the analysis was performed with both task types together, and for each task type individually.

For both tasks, an analysis of the average completion time showed statistically significant results between symmetry modes ($F_1$, 79=9.31, p=0.003), coupling stiffnesses ($F_1$, 79=4.69, p=0.03) and task types ($F_1$, 79=131.2, p<0.001).

Figure 13:
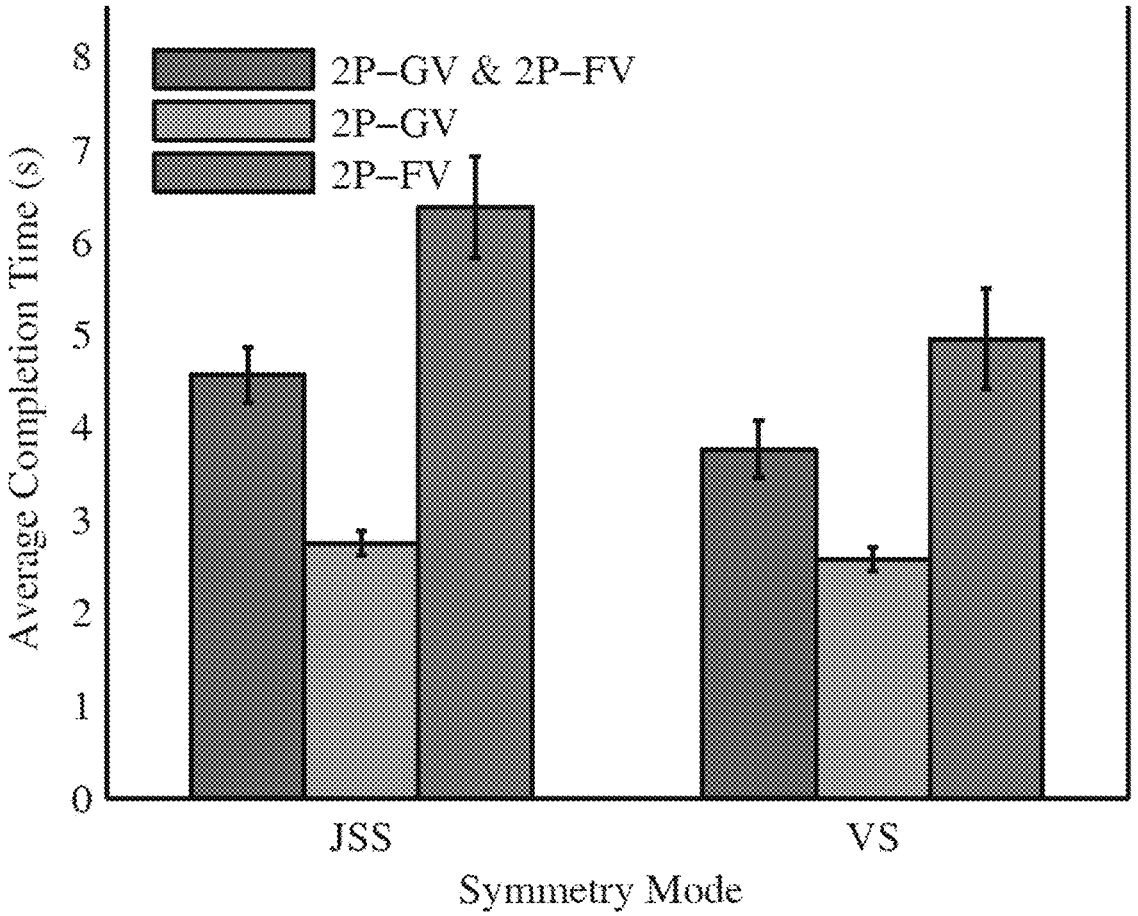
FIG. 13 is a graphical illustration depicting results of average completion time analysis for Two Participant Study. When the guiding handle and desired position are visible (GV), the completion times are similar. When the guiding participant must move the follower's handle (FV), the task is completed faster in VS. Error bars represent 95% confidence interval.

Post hoc analysis showed that the completion time was lower for VS mode, for the 110 N/m coupling stiffness, and for the 2P-GV task. The completion times for the symmetry modes and tasks are shown in FIG. 13. The average completion time for 2P-GV was 2.7 s, and the average completion time for 2P-FV was 5.7 s.

For the 2P-GV task, analysis of the average completion time did not show statistically significant results between symmetry modes or coupling stiffnesses. For the 2P-FV task, analysis of the average completion time showed statistically significant results between symmetry modes ($F_1$, 39=9.45, p=0.004). Post hoc analysis showed that the average completion time was lower for VS than for JSS.

For both tasks, analysis of the average coupled position error showed statistically significant results between symmetry modes ($F_1$, 79=4.90, p=0.03) and coupling stiffnesses ($F_1$, 79=265.48, p<0.001). Post hoc analysis showed that the error was smaller for JSS than VS, 51 mm and 56 mm, respectively, and that the error was lower for the 380 N/m coupling stiffness than for the 110 N/m coupling stiffness.

For the 2P-GV task, analysis of the average coupled position error showed statistically significant results between coupling stiffnesses ($F_1$, 39=140.53, p<0.001). For the 2P-FV task, analysis of the coupled position error showed statistically significant results between coupling stiffnesses ($F_1$, 39=117.97, p<0.001). Post hoc analysis showed that the average error was lower for the 380 N/m coupling stiffness and was comparable to the average for both tasks.

Results—Single Participant Study

For the single participant study, the analysis was performed both with the data from the three tasks combined as well as for the data of the tasks individually. The coupled position error was only analyzed for the 1P-SV task because in the other tasks, the correct final position for both handles was displayed For all three tasks and both coupling conditions, analysis of the average completion time showed statistically significant results between the task types ($F_2$, 143=40.17, p<0.001). Post hoc analysis showed that 1P-SV was completed faster than 1P-BV, which, in turn, was completed faster than 1P-DP. The average completion times for 1P-SV, 1P-BV, and 1P-DP were 2.2 s, 2.8 s, and 3.3 s, respectively.

Figure 14:
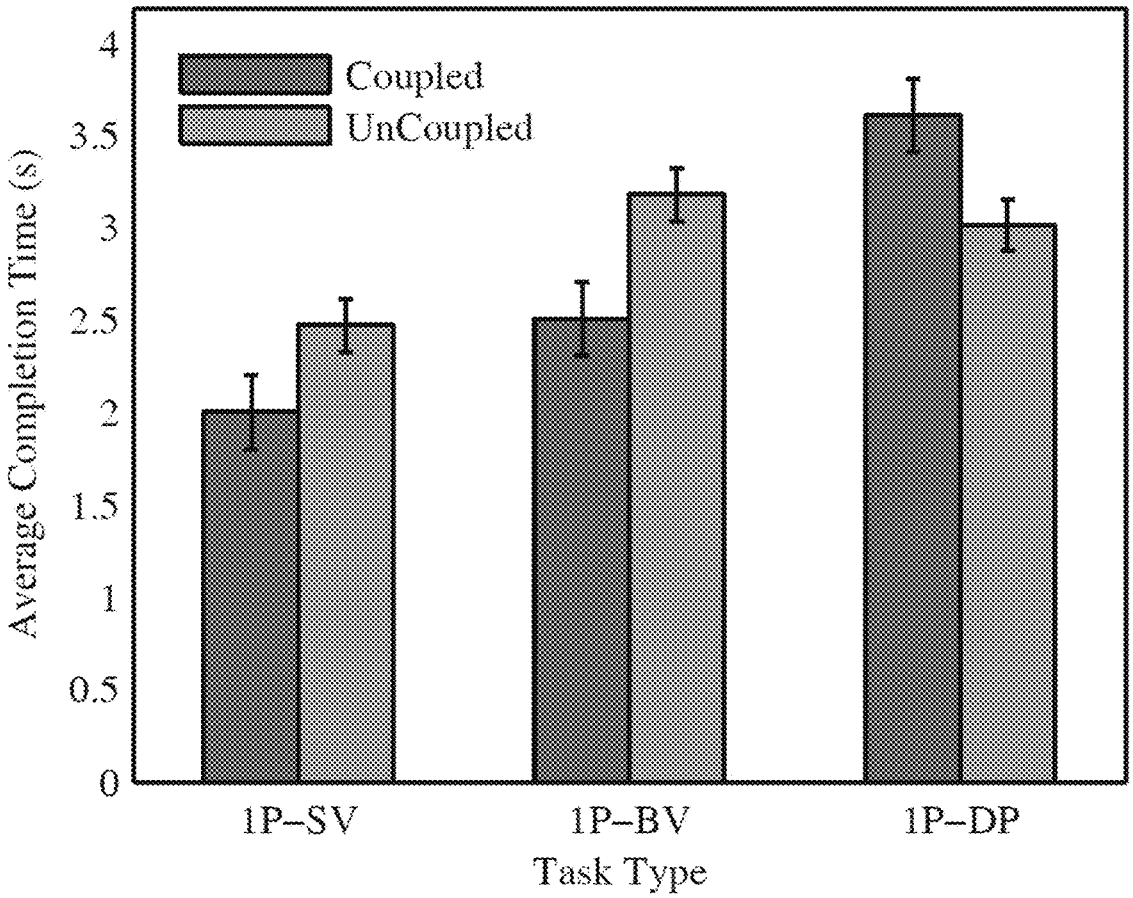
FIG. 14 is a graphical illustration depicting results of average completion time analysis for Single Participant Study. For 1P-SV and 1P-BV, the average completion time was lower when the handles were coupled. Error bars represent 95% confidence interval.

For the 1P-SV task and both coupling conditions, analysis of the average completion time showed statistically significant results between coupling conditions ($F_1$, 47=40.17, p=0.003). Post hoc analysis showed that the task was completed faster with the handles coupled (FIG. 14). In other words, coupling improves the completion times when the desired positions are in symmetric locations consistent with the coupling.

For the coupled 1P-SV task, analysis of the average completion time showed statistically significant results between symmetry modes ($F_1$, 23=7.14, p=0.05). Post hoc analysis showed that the task was completed faster in VS than in JSS. For the uncoupled 1P-SV task, analysis of the average completion time did not show statistically significant results. In other words, it was found that the time to place one handle in the desired position while uncoupled was comparable to matching both positions when the handles were coupled.

For the 1P-BV task and both coupling conditions, analysis of the average completion time showed statistically significant results between coupling conditions ($F_1$, 47=34.13, p=0.001). Post hoc analysis showed that the task was completed faster when the handles were coupled (FIG. 14).

For the 1P-DP task and both coupling conditions, analysis of the average completion time showed statistically significant results between coupling conditions ($F_1$, 47=11.24, p=0.002). Post hoc analysis showed that the task was completed faster when the handles were uncoupled (FIG. 14). Analysis of the completion time for the uncoupled 1P-DP task showed statistically significant differences between symmetry modes ($F_1$, 23=15.34, p=0.001). Post hoc analysis showed that the task was completed faster in JSS than in VS. Analysis of the completion time for the coupled 1P-DP task did not show statistically significant results.

For the 1P-SV task and both coupling conditions, analysis of the coupled position error showed statistically significant results between symmetry modes ($F_1$, 47=8.7, p=0.005) and coupling conditions ($F_1$, 47=32.2, p<0.001). Post hoc analysis showed that the error was smaller in JSS than in VS, and when the handles were coupled.

For the coupled 1P-SV task, analysis of the coupled position error showed statistically significant results between symmetry modes ($F_1$, 23=45.54, p<0.001). Post hoc analysis showed that the error was smaller for JSS than VS. For the uncoupled 1P-SV task, the error did not show statistically significant results between symmetry modes.

Discussion

The two participant study showed that both the 380 N/m coupling stiffness and VS mode results in faster completion times. The higher stiffness may improve completion time due to better haptic communication with the following participant, but may also be attributable to better control over the dynamic motion of the system. The fact that 2P-FV task is completed faster in VS than in JSS, as shown in FIG. 13, makes sense because in JSS the guiding participant must account for the mirrored motion of the handle that he is attempting to move to the desired position, while in VS the following handle moves in the same direction as the handle that he is controlling directly. This indicates that for bimanual rehabilitation tasks in JSS mode, it may be beneficial to display the desired position of both handles so that an individual may focus on generating both motions together rather than on the motion of the healthy arm required to assist the impaired arm in the correct direction.

The two participant study also showed that the coupled position error is smaller for the 380 N/m coupling stiffness than for the 110 N/m coupling stiffness at approximately 30 mm and 75 mm, respectively, corresponding to forces applied of 11.4 N and 8.25 N, respectively, which is consistent with the friction in the coupling system. In other words, the 380 N/m coupling stiffness resulted in a smaller error between the handle positions (30 mm vs. 75 mm).

The coupled position error showed a difference between symmetry modes, indicating that there may be a difference in performance in coupling modes, although the difference is on the order of 10% of the coupled position error.

The 1P-SV task with the handles coupled showed that the average completion time was lower for VS than for JSS. This is consistent with the idea that many VS tasks, such as moving a large object, are done with the hands coupled together, and may be a more natural symmetry mode if only the desired position of one handle is displayed. However, preliminary studies [19] show that uncoupled non-harmonic motions should also be faster in VS than in JSS. The difference may be attributable to friction and inertial forces slowing the motions enough to mask the differences in completion time. Therefore, further coupled bimanual studies on a device with lower impedance should be conducted, and an effort should be made to reduce the impedance of the CBRD.

For the 1P-DP task, the average completion time was lower when the handles were uncoupled. This makes sense because when the handles are coupled for this task, the participant must fight against the device to move the handles to the distorted desired positions. The forces required to reach the desired positions ranged from about 0 N to about 45 N.

The single participant study also showed that for the 1P-SV and 1P-BV tasks, when the handles were coupled in the desired symmetry mode, the average completion time was lower, as shown in FIG. 14. The figure also shows that the average completion time for 1P-SV uncoupled is comparable to 1P-BV coupled, demonstrating that coupling motions through the CBRD can reduce the difficulty of matching two visually displayed positions to that of matching only one. These results show that coupling the hand motions through the CBRD improves performance of a healthy subject at completing bimanual tasks, indicating that it should be implemented in bimanual rehabilitation studies to test its efficacy.

In conclusion, the results of the study show that the CBRD effectively couples the bimanual motions of healthy subjects in JSS and VS modes, and that a higher coupling stiffness results in better performance in two participant bimanual tasks simulating hemiparesis. This two participant study also showed that when only the desired position of the following participant was displayed, the trials were completed faster in VS than JSS, and that displaying both desired positions in a JSS bimanual rehabilitation task may be beneficial.

REFERENCES

[1] L. Marchal-Crespo and D. Reinkensmeyer, "Review of control strategies for robotic movement training after neurologic injury." Journal of NeuroEngineering and Rehabilitation, vol. 6, no. 1, p. 20, 2009.

[2] G. Kwakkel, B. J. Kollen, and H. I. Krebs, "Effects of Robot-Assisted Therapy on Upper Limb Recovery After Stroke: A Systematic Review," Neurorehabil Neural Repair, vol. 22, no. 2, pp. 111-121, 2008.

[3] B. Bobath, Adult hemiplegia: Evaluation and treatment. London, UK: Heinemann Medical Books Ltd., 1970.

[4] M. Knott and D. Voss, Proprioceptive Neuromuscular Facilitation: Patterns and Techniques, 2ed. 2nd ed. New York, N.Y.: Harper & Row Publishers Inc., 1968.

[5] R. Oden, "Systematic therapeutic exercises in the management of the paralyses in hemiplegia," JAMA, vol. 23, pp. 828-833, 1918.

[6] E. Taub, G. Uswatte, and R. Pidikiti, "Constraint-induced movement therapy: A new family of techniques with broad application to physical rehabilitation-a clinical review," Journal of Rehabilitation Res, vol. 36, no. 3, pp. 237-251, 1999.

[7] M. Johnson, X. Feng, L. Johnson, and J. Winters, "Potential of a suite of robot/computer-assisted motivating systems for personalized, home-based, stroke rehabilitation," Journal of NeuroEngineering and Rehabilitation, vol. 4, no. 1, p. 6, 2007.

[8] D. J. Reinkensmeyer, C. T. Pang, J. A. Nessler, and C. C. Painter, "Java therapy: Web-based robotic rehabilitation," Integration of Assistive Technology in the Information Age, vol. 9, pp. 66-71, 2001.

[9] C. Burgar, P. Lum. P. Shor, and H. Van der Loos, "Development of robots for rehabilitation therapy: The Palo Alto VA/Stanford experience," J. of Rehab Research and Development, vol. 37, pp. 663-674, 2000.

[10] S. L. Wolf, D. E. LeCraw, and L. A. Barton, "Comparison of Motor Copy and Targeted Biofeedback Training Techniques for Restitution of Upper Extremity Function Among Patients with Neurologic Disorders," Physical Therapy, vol. 69, no. 9, pp. 719-735, 1989.

[11] P. Lum, D. Reinkensmeyer, R. Mahoney, W. Z. Rymer, and C. Burgar, "Robotic devices for movement therapy after stroke: Current status and challenges to clinical acceptance," Topics in Stroke Rehab, vol. 8, pp. 40-53, 2002.

[12] S. Hesse, G. Schulte-Tigges, M. Konrad, A. Bardeleben, and C. Werner, "Robot-assisted arm trainer for the passive and active practice of bilateral forearm and wrist movements in hemiparetic subjects," Archives of Physical Medicine and Rehab, vol. 84, no. 6, pp. 915-920, 2003.

[13] J. Whitall, S. Waller, K. Silver, and R. Macko, "Repetitive Bilateral Arm Training With Rhythmic Auditory Cueing Improves Motor Function in Chronic Hemiparetic Stroke," Stroke, vol. 31, no. 10, pp. 2390-2395, 2000.

[14] K. Jordan, M. Sampson, J. Hijmans, M. King, and L. Hale, "Imable system for upper limb stroke rehabilitation," in Virtual Rehabilitation (ICVR), 2011 International Conference on, June 2011, pp. 1-2.

[15] S. Hesse, C. Werner, M. Pohl, J. Mehrholz, U. Puzich, and H. I. Krebs, "Mechanical arm trainer for the treatment of the severely affected arm after a stroke," Am J Phys Med Rehabil, vol. 87, pp. 779-788, 2008.

[16] R. A. Schmidt and R. A. Bjork, "New conceptualizations of practice: Common principles in three paradigms suggest new concepts for training," Psychological Science, vol. 3, no. 4, pp. 207-217, 1992.

[17] H. G. Malabet, R. A. Robles, and K. B. Reed, "Symmetric motions for bimanual rehabilitation," in Proc. IEEE/RSJ Int Intelligent Robots and Systems (IROS) Conf, 2010, pp. 5133-5138.

[18] S. McAmis and K. B. Reed, "Symmetry modes and stiffnesses for bimanual rehabilitation," in Proc. IEEE Int. Conf. Rehabilitation Robotics, 2011, pp. 1106-1111.

[19] S. H. L. McAmis and K. B. Reed, "Simultaneous perception of forces and motions using bimanual interactions," Haptics, IEEE Transactions on, vol. 5, no. 3, pp. 220-230, 2012.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

Glossary of Claim Terms

Cable and pulley assembly: This term is used herein to refer to a mechanism by which one or more cables loops around one or more pulleys to change direction of the cable and transmit tension forces around the pulleys to apply a biased force against a load or structure.

Carrier assembly: This term is used herein to refer to a slidable structure to which the upper assembly is connected. In other words, the carrier assembly carries the upper assembly, handle slides, compliant handle assemblies, among other components of the overall rehabilitation device.

Compliant handle assembly: This term is used herein to refer to a set of structural components that function in unison, where the structural components are related to the movement of the connected handles under a particular stiffness and to rehabilitation of the user.

Connection joint: This term is used herein to refer to the point or area at which two structures meet and are coupled to each other.

Coupling stiffness: This term is used herein to refer to the bias or rigidity of a connection between two structures.

Current position: This term is used herein to refer to an indication of the virtual or digital location of a handle as seen on an electronic visual display, where the location corresponds to the actual physical location of the handle.

Encoder: This term is used herein to refer to a device that reads particular information and transmits that information to an electronic device in a readable format.

Following handle: This term is used herein to refer to the handle used by the user's paretic arm led by movement of the guiding handle used by the user's sound arm.

Fork: This term is used herein to refer to a component of an exemplary torsion spring used herein, where the component includes an elongate body with tines at the end that can surround or "grab" a post for stability of the torsion spring.

Guiding handle: This term is used herein to refer to the handle used by the user's sound arm to lead movement of the following handle used by the user's paretic arm.

Handle slide: This term is used herein to refer to a slidable structure that slides into and out of the upper assembly and to which the compliant handle assemblies are connected.

Indirectly linked: This term is used herein to refer to a connection between two structures without the structures actually being held together or directly attached to one another. In other words, the structures are connected to each other through other structures.

Load cell: This term is used herein to refer to a transducer that reads a user's force and transmits data regarding that force to an electronic device in a readable format.

Locking mechanism: This term is used herein to refer to any suitable structure (e.g., bolt, plate, etc.) that can be used to block or restrict movement of a structure in a particular direction.

Mirror: This term is used herein to refer to movement of two structures where the structures reflect each other. As such, the structures move in opposite directions in the x-axis and in the same direction in the y-axis.

Paretic arm: This term is used herein to refer to an arm characterized by any weakness of voluntary movement. The arm may be partially paralyzed, have reduced capability of voluntary movement, or otherwise be impaired.

Same absolute direction: This term is used herein to refer to movement of two structures in the same manner or course.

Sound arm: This term is used herein to refer to an arm characterized as being healthy or normal relative to a paretic arm.

Spring stack: This term is used herein to refer to an assembly of springs that abut one another to collectively form a unified spring system.

Spring system: This term is used herein to refer to an assembly or one or more mechanical structures, each having an inherent bias toward its normal position, such that it exerts a force toward its normal position when bent, compressed, or stretched.

Symmetry mode: This term is used herein to refer to a technique of upper limb rehabilitation where movement of the sound and paretic limbs correspond to one another, whether mirroring each other, moving in the same absolute direction, moving in opposite directions from each other, among other suitable patterns.

Target position: This term is used herein to refer to a virtual or digital indication of a desired location of a handle during rehabilitation, as seen on an electronic visual display.

Torsion spring: This term is used herein to refer to a spring that function by rotation, twisting, or other force. When twisted, torsion springs store mechanical energy and apply a force toward their normal positions. Thus, the more torsion springs that are used, the greater the force needed to maintain their twisted position.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A rehabilitation system including a compliant bimanual rehabilitation device, comprising:

a base that defines a left side, a right side, a front side, a rear side, an x-axis, a y-axis, and a z-axis of said device, wherein said base has a top side and a bottom side;

a carrier assembly slidably coupled to said base, said carrier assembly being slidable along the y-axis of said device;

an upper assembly rotationally coupled to said carrier assembly, said upper assembly being rotational about the z-axis of said device, said upper assembly having a left end corresponding to said left side of said device and a right end corresponding to said right side of said device;

a left handle slide slidably coupled to said left end of said upper assembly, said left handle slide being slidable along the x-axis of said device;

a right handle slide slidably coupled to said right end of said upper assembly, said right handle slide being slidable along the x-axis of said device;

a left compliant handle assembly coupled to said left handle slide and extending from said left handle slide;

a right compliant handle assembly coupled to said right handle slide and extending from said right handle slide;

a left handle fixedly coupled to said left compliant handle assembly;

a right handle fixedly coupled to said right compliant handle assembly, wherein one of said left handle and said right handle is a guiding handle and the other of said left handle and said right handle is a following handle, wherein said left handle and said right handle are linked to each other, such that when said device is in use, a paretic arm of a user or operator of said device is linked to a sound arm of said user of said device, such that a movement of said guiding handle dictates a corresponding movement of said following handle according to a predetermined symmetry mode, said left handle and said right handle linked to each other via said left handle slide and said right handle slide being coupled to each other, thus also coupling said left compliant handle assembly and said right compliant handle assembly to each other, wherein said left compliant handle assembly and said right compliant handle assembly can be coupled to each other in a first configuration so that said left handle and said right handle move in a same absolute direction or in a second configuration so that said left handle and said right handle mirror each other, and wherein said carrier assembly being slidably coupled to said base via slide rails mounted on said top side of said base.

2. A rehabilitation system as in claim 1, further comprising:

a left handle slide encoder in communication with said left handle slide in order to determine a position of said left handle slide along the x-axis of said device; and a right handle slide encoder in communication with said right handle slide in order to determine a position of said right handle slide along the x-axis of said device, wherein said left and right handle slide encoders are in further communication with an electronic device in order to transmit the positions of said left and right handle slides to said electronic device.

3. A rehabilitation system as in claim 2, further comprising:

a carrier assembly encoder in communication with said carrier assembly in order to determine a position of said carrier assembly along the y-axis of said device, wherein said carrier assembly encoder is in further communication with said electronic device in order to transmit the position of said carrier assembly to said electronic device.

4. A rehabilitation system as in claim 3, further comprising:

an upper assembly encoder in communication with said upper assembly in order to determine a position of said upper assembly about the z-axis of said device, wherein said upper assembly encoder is in further communication with said electronic device in order to transmit the position of said upper assembly to said electronic device.

5. A rehabilitation system as in claim 1, further comprising:

a first load cell in communication with said left compliant handle assembly to determine an amount of force placed by said user on said left compliant handle assembly; and a second load cell in communication with said right compliant handle assembly to determine an amount of force placed by said user on said right compliant handle assembly, wherein said first and second load cells are in further communication with an electronic device in order to transmit the amounts of force on said left and right compliant handle assemblies to said electronic device.

6. A rehabilitation system as in claim 1, further comprising:

said left compliant handle assembly including a first left compliant handle assembly component coupled to and extending from said left handle slide along the y-axis of said device, said left compliant handle assembly further including a second left compliant handle assembly component coupled to and extending inwardly from said first left compliant handle assembly component, and said right compliant handle assembly including a first right compliant handle assembly component coupled to and extending from said right handle slide along the y-axis of said device, said right compliant handle assembly further including a second right compliant handle assembly component coupled to and extending inwardly from said first right compliant handle assembly component.

7. A rehabilitation system as in claim 6, further comprising:

a first left load cell positioned along and in communication with said first left compliant handle assembly component to determine an amount of force placed by said user on said first left compliant handle assembly component;

a second left load cell positioned along and in communication with said second left compliant handle assembly component to determine an amount of force placed by said user on said second left compliant handle assembly component, wherein said first and second left load cells are in further communication with an electronic device in order to transmit the amount of force on said left compliant handle assembly to said electronic device;

a first right load cell positioned along and in communication with said first right compliant handle assembly component to determine an amount of force placed by said user on said first right compliant handle assembly component; and a second right load cell positioned along and in communication with said second right compliant handle assembly component to determine an amount of force placed by said user on said second right compliant handle assembly component, wherein said first and second right load cells are in further communication with said electronic device in order to transmit the amount of force on said right compliant handle assembly to said electronic device.

8. A rehabilitation system as in claim 1, further comprising:

said left handle slide and said right handle slide being coupled to each other via a cable and pulley assembly including at least one cable and at least two pulleys.

9. A rehabilitation system as in claim 8, wherein:

when said at least one cable is looped around said at least two pulleys an even number of times, said left handle and said right handle move in a same absolute direction, and when said at least one cable is looped around said at least two pulleys an odd number of times, said left handle and said right handle mirror each other.

10. A rehabilitation system as in claim 1, further comprising:

a first spring system coupled to said left compliant handle assembly to provide a bias against movement of said left handle; and a second spring system coupled to said right compliant handle assembly to provide a bias against movement of said right handle.

11. A rehabilitation system as in claim 10, further comprising:

said first spring system including a first spring disposed at a connection joint between said left handle slide and said left compliant handle assembly, said first spring system further including a second spring disposed within said left compliant handle assembly, and said second spring system including a third spring disposed at a connection joint between said right handle slide and said right compliant handle assembly, said second spring system further including a fourth spring disposed within said right compliant handle assembly.

12. A rehabilitation system as in claim 11, further comprising:

said left compliant handle assembly including a first left compliant handle assembly component coupled to and extending from said left handle slide along the y-axis of said device, said left compliant handle assembly further including a second left compliant handle assembly component coupled to and extending inwardly from said first left compliant handle assembly component, said second spring disposed at a connection joint between said first left compliant handle assembly component and said second left compliant handle assembly component, said right compliant handle assembly including a first right compliant handle assembly component coupled to and extending from said right handle slide along the y-axis of said device, said right compliant handle assembly further including a second right compliant handle assembly component coupled to and extending inwardly from said first right compliant handle assembly component, and said fourth spring disposed at a connection joint between said first right compliant handle assembly component and said second right compliant handle assembly component.

13. A rehabilitation system as in claim 10, further comprising:

said first spring system being a first spring stack formed of a plurality of torsion springs stacked or abutting one another, and said second spring system being a second spring stack formed of a plurality of torsion springs stacked or abutting one another, whereby a predetermined coupling stiffness between left handle and said right handle can be adjusted, based on said user, by adding or removing torsion springs from said first and second spring stacks.

14. A rehabilitation system as in claim 13, further comprising:

said torsion springs each including a central portion and two (2) forks extending from said central portion, said two (2) forks having longitudinal extents that are angled relative to each other.

15. A rehabilitation system as in claim 1, further comprising:

a first locking mechanism for restricting movement of said upper assembly about the z-axis of said device; and a second locking mechanism for restricting movement of said carrier assembly in the y-axis of said device.

16. A rehabilitation system as in claim 1, further comprising:

a visual display communicatively coupled to said device for indicating a current left position of said left handle and a current right position of said right handle, wherein said current left position and said current right position move as said left handle and said right handle respectively move.

17. A rehabilitation system as in claim 16, further comprising:

said visual display further indicating a target left position of said left handle and a target right position of said right handle, whereby a goal of said user is to align said current left position with said target left position and align said current right position with said target right position.

18. A rehabilitation system including a compliant bimanual rehabilitation device, comprising:

a base that defines a left side, a right side, a front side, a rear side, an x-axis, a y-axis, and a z-axis of said device, wherein said base has a top side and a bottom side;

a carrier assembly slidably coupled to said base via slide rails mounted on said top side of said base, said carrier assembly being slidable along the y-axis of said device;

a carrier assembly encoder in communication with said carrier assembly in order to determine a position of said carrier assembly along the y-axis of said device, wherein said carrier assembly encoder is in further communication with an electronic device in order to transmit the position of said carrier assembly to said electronic device;

an upper assembly rotationally coupled to said carrier assembly, said upper assembly being rotational about the z-axis of said device, said upper assembly having a left end corresponding to said left side of said device and a right end corresponding to said right side of said device;

an upper assembly encoder in communication with said upper assembly in order to determine a position of said upper assembly about the z-axis of said device, wherein said upper assembly encoder is in further communication with said electronic device in order to transmit the position of said upper assembly to said electronic device;

a left handle slide slidably coupled to said left end of said upper assembly, said left handle slide being slidable along the x-axis of said device;

a left handle slide encoder in communication with said left handle slide in order to determine a position of said left handle slide along the x-axis of said device, wherein said left slide encoder is in further communication with said electronic device in order to transmit the position of said left handle slide to said electronic device;

a right handle slide slidably coupled to said right end of said upper assembly, said right handle slide being slidable along the x-axis of said device;

a right handle slide encoder in communication with said right handle slide in order to determine a position of said right handle slide along the x-axis of said device, wherein said right handle slide encoder is in further communication with said electronic device in order to transmit the position of said right handle slide to said electronic device;

a left compliant handle assembly coupled to said left handle slide and extending from said left handle slide, said left compliant handle assembly including a first left compliant handle assembly component coupled to and extending from said left handle slide along the y-axis of said device, said left compliant handle assembly further including a second left compliant handle assembly component coupled to and extending inwardly from said first left compliant handle assembly component;

a first left load cell positioned along and in communication with said first left compliant handle assembly component to determine an amount of force placed by said user on said first left compliant handle assembly component;

a second left load cell positioned along and in communication with said second left compliant handle assembly component to determine an amount of force placed by said user on said second left compliant handle assembly component, wherein said first and second left load cells are in further communication with said electronic device in order to transmit the amount of force on said left compliant handle assembly to said electronic device;

a right compliant handle assembly coupled to said right handle slide and extending from said right handle slide, said right compliant handle assembly including a first right compliant handle assembly component coupled to and extending from said right handle slide along the y-axis of said device, said right compliant handle assembly further including a second right compliant handle assembly component coupled to and extending inwardly from said first right compliant handle assembly component;

a first right load cell positioned along and in communication with said first right compliant handle assembly component to determine an amount of force placed by said user on said first right compliant handle assembly component;

a second right load cell positioned along and in communication with said second right compliant handle assembly component to determine an amount of force placed by said user on said second right compliant handle assembly component;

wherein said first and second right load cells are in further communication with said electronic device in order to transmit the amount of force on said right compliant handle assembly to said electronic device;

a left handle fixedly coupled to said left compliant handle assembly;

a right handle fixedly coupled to said right compliant handle assembly, wherein one of said left handle and said right handle is a guiding handle and the other of said left handle and said right handle is a following handle, wherein said left handle and said right handle are indirectly linked to each other at an adjustable, predetermined coupling stiffness via said left handle slide and said right handle slide being coupled to each other, thus also coupling said left compliant handle assembly and said right compliant handle assembly to each other, wherein said left compliant handle assembly and said right compliant handle assembly can be coupled to each other in a first configuration so that said left handle and said right handle move in a same absolute direction or in a second configuration so that said left handle and said right handle mirror each other, wherein when said device is in use, a paretic arm of a user or operator of said device is linked to a sound arm of said user of said device, such that a movement of said guiding handle dictates a corresponding movement of said following handle according to a predetermined symmetry mode;

a first locking mechanism for restricting movement of said upper assembly about the z-axis of said device, a second locking mechanism for restricting movement of said carrier assembly in the y-axis of said device;

a first spring system coupled to said left compliant handle assembly to provide a bias against movement of said left handle, said first spring system including a first spring stack disposed at a connection joint between said left handle slide and said left compliant handle assembly, said first spring system further including a second spring stack disposed at a connection joint between said first left compliant handle assembly component and said second left compliant handle assembly component, said first and second spring stacks each formed of a plurality of torsion springs stacked on each other;

a second spring system coupled to said right compliant handle assembly to provide a bias against movement of said right handle, said second spring system including a third spring stack disposed at a connection joint between said right handle slide and said right compliant handle assembly, said second spring system further including a fourth spring stack disposed at a connection joint between said first right compliant handle assembly component and said second right compliant handle assembly component, said third and fourth spring stacks each formed of a plurality of torsion springs stacked on each other, whereby said predetermined coupling stiffness can be adjusted, based on said user, by adding or removing torsion springs from said first and second spring stacks, said torsion springs each including a central portion and two (2) forks extending from said central portion, said two (2) forks having longitudinal extents that are substantially perpendicular to each other; and a visual display communicatively coupled to said device for indicating a current left position of said left handle and a current right position of said right handle, wherein said current left position and said current right position move as said left handle and said right handle respectively move, said visual display further indicating a target left position of said left handle and a target right position of said right handle, whereby a goal of said user is to align said current left position with said target left position and align said current right position with said target right position.

19. A rehabilitation system as in claim 18, further comprising:

said left handle slide and said right handle slide being coupled to each other via a cable and pulley assembly including at least one cable and at least two pulleys, wherein when said at least one cable is looped around said at least two pulleys an even number of times, said left handle and said right handle move in a same absolute direction, and when said at least one cable is looped around said at least two pulleys an odd number of times, said left handle and said right handle mirror each other.

* * * * *